US008006877B2

(12) United States Patent
Lowry et al.

(10) Patent No.: US 8,006,877 B2
(45) Date of Patent: Aug. 30, 2011

(54) BACKPACK FOR SELF CONTAINED BREATHING APPARATUS

(75) Inventors: Philip L. Lowry, Placentia, CA (US); Nicolo J. Luzie, Jr., Mission Viejo, CA (US); James T. Dexter, Huntington Beach, CA (US); Thuan C. Le, Cerritos, CA (US); Mark A. Fischer, Mission Viejo, CA (US); Aaron D. DeLaby, Carlsbad, CA (US)

(73) Assignee: Sperian Respiratory Protection USA, LLC, Santa Ana, CA (US)

( * ) Notice: Subject to any disclaimer, the term of this patent is extended or adjusted under 35 U.S.C. 154(b) by 804 days.

(21) Appl. No.: 12/105,094

(22) Filed: Apr. 17, 2008

(65) Prior Publication Data

US 2008/0257928 A1 Oct. 23, 2008

Related U.S. Application Data

(60) Provisional application No. 60/925,036, filed on Apr. 18, 2007.

(51) Int. Cl.

| | |
|---|---|
| ***A45F 3/00*** | (2006.01) |
| ***A45F 3/08*** | (2006.01) |
| ***A45F 5/00*** | (2006.01) |
| ***A45C 1/04*** | (2006.01) |

(52) U.S. Cl. ..... 224/633; 224/638; 224/262; 224/271; 224/628; 224/660

(58) Field of Classification Search ..... 224/663, 224/638, 262, 628, 645, 627, 259, 261, 634, 224/660; 340/540, 321; 128/204.26; 405/186
See application file for complete search history.

(56) References Cited

U.S. PATENT DOCUMENTS

| | | | | |
|---|---|---|---|---|
| 3,035,747 | A * | 5/1962 | Ullrich, Jr. | 224/265 |
| 3,090,205 | A * | 5/1963 | Hurwitz et al. | 405/186 |
| 3,191,828 | A | 6/1965 | Senne | |
| 3,355,075 | A | 11/1967 | Dean | |
| 3,957,183 | A * | 5/1976 | Gadberry | 224/628 |
| 4,015,759 | A | 4/1977 | Dreissigacker et al. | |
| 4,049,164 | A * | 9/1977 | Sullivan et al. | 224/633 |
| 4,250,876 | A * | 2/1981 | Kranz | 128/202.22 |
| 4,310,110 | A * | 1/1982 | Dexter | 224/246 |
| 4,327,851 | A * | 5/1982 | Feathers | 224/634 |
| 4,498,471 | A * | 2/1985 | Kranz et al. | 128/204.26 |

(Continued)

FOREIGN PATENT DOCUMENTS

DE 33 42 202 A1 7/1984

(Continued)

OTHER PUBLICATIONS

Draeger AirBoss Plus Series; 2002; 8 pages.

(Continued)

*Primary Examiner* — Justin M Larson
*Assistant Examiner* — Lester L Vanterpool
(74) *Attorney, Agent, or Firm* — Knobbe, Martens, Olson and Bear, LLP

(57) ABSTRACT

A backpack assembly for a self contained breathing apparatus comprises a plurality of components positioned in housings that define a body for the backpack assembly. The body is assembled to a back frame. A pivoting and swiveling hip plate is connected to the back frame in multiple distinct positions to provide a customizable and comfortable fit for the wearer.

53 Claims, 32 Drawing Sheets

U.S. PATENT DOCUMENTS

| | | | | | |
|---|---|---|---|---|---|
| 4,779,554 | A | * | 10/1988 | Courtney | 114/315 |
| 4,913,589 | A | * | 4/1990 | Faulconer et al. | 405/186 |
| 4,952,095 | A | | 8/1990 | Walters | |
| 5,131,576 | A | * | 7/1992 | Turnipseed | 224/262 |
| 5,249,890 | A | * | 10/1993 | Bergstrom | 405/186 |
| 5,492,110 | A | * | 2/1996 | Lenz et al. | 128/202.22 |
| 5,823,414 | A | | 10/1998 | Gal et al. | |
| 5,954,250 | A | * | 9/1999 | Hall et al. | 224/262 |
| 6,091,331 | A | * | 7/2000 | Toft et al. | 340/539.11 |
| 6,290,111 | B1 | * | 9/2001 | Hedenberg et al. | 224/262 |
| 6,848,120 | B2 | | 2/2005 | Kling et al. | |
| 7,198,186 | B2 | * | 4/2007 | Kling et al. | 224/628 |
| 7,367,749 | B2 | * | 5/2008 | Kim | 405/186 |
| 7,647,927 | B2 | * | 1/2010 | Teetzel et al. | 128/205.12 |
| 2004/0000311 | A1 | * | 1/2004 | Lowry | 128/204.26 |

FOREIGN PATENT DOCUMENTS

| | | | |
|---|---|---|---|
| DE | 297 04 328 | U1 | 7/1997 |
| EP | 0 903 162 | A2 | 3/1999 |
| WO | 2005/048769 | A | 6/2005 |

OTHER PUBLICATIONS

International Search Report; dates Oct. 22, 2008; 3 pages.

* cited by examiner

BACKPACK FOR SELF CONTAINED BREATHING APPARATUS

CROSS-REFERENCE TO RELATED APPLICATIONS

This application claims the priority benefit of U.S. Provisional Patent Application No. 60/925,036, filed Apr. 18, 2007, which is hereby incorporated by reference in its entirety.

BACKGROUND OF THE INVENTION

1. Field of the Invention

The present invention generally relates to a backpack assembly for a self contained breathing apparatus.

2. Description of the Related Art

Self contained breathing apparatuses ("SCBA") are used by firefighters, for instance, while fighting fires. The SCBA generally include backpack assemblies that support many of the components of the SCBA. Because many of the components are modular in nature, many of the components dangle from the backpack assembly and can form potential snag points during movement within a structure. Firefighters have grown accustomed to this but improvement over the prior constructions is possible.

In addition, the backpack assemblies are strapped to the hip/waist region of the firefighters using hip pads. To improve comfort, the pads can be configured to move relative to the balance of the backpack assembly. Such movement, however, can cause some psychological discomfort if the firefighter does not believe that the backpack assembly is tightly secured in position.

SUMMARY OF THE INVENTION

Accordingly, an improved backpack assembly features several components that are integrated into a streamlined body such that potential snag points are greatly reduced. The integrated body also results in a sleek design that greatly reduces or eliminates bulky protrusions that restrict movement.

In addition, a swiveling and pivoting hip plate is provided to attach the hip pad to the balance of the backpack assembly. The configuration disclosed limits movement in manners that improve the fit while improving the feedback from the backpack assembly to the firefighter.

Other improvements also include: an improved tank band assembly that can facilitate rapid exchanges of air cylinders including air cylinders having varied diameters and valve stem configurations; colorized straps to quickly identify twists in the straps when the backpack assembly is being put on; a low air warning (audible and/or visual) on a back surface of the backpack assembly so others following the firefighter will be able to identify a low air supply condition if the firefighter does not identify it himself; handles and carabineer attachment points on the backpack assembly that have a pull strength of 1000 pounds or more; enlarged grabs to help tighten the backpack assembly straps while wearing gloves; and an adjustable hip plate assembly that enables the backpack assembly to be customized for various body sizes and shapes.

Some aspects of some embodiments of the present invention involve a backpack assembly for a self contained breathing apparatus. The backpack assembly comprises a back frame that has a forward surface and a rearward surface. The forward surface has a lower portion. A hip plate is positioned along the lower portion of the forward surface. In some configurations, as discussed below, the hip plate can be located in other regions of the forward surface, such as a mid portion, to accommodate various body structures of the end users. A bushing is positioned between the hip plate and the forward surface of the back frame. A plate covers at least a portion of the bushing. A pin connects the hip plate to the back frame and the pin is positioned between at least a portion of the bushing and at least a portion of the plate. In some embodiments, the bushing comprises fingers that contact the pin. In some embodiments, the pin is adapted for rotational movement in a radial direction of the pin such that the hip plate can swivel relative to the back plate about a first axis while pivoting relative to the pin about a second axis. The first axis preferably is generally normal to said second axis. In some embodiments, the bushing can be mounted to the back frame in multiple locations such that the height of the hip plate relative to the back frame can be adjusted.

Some aspects of some embodiments of the present invention relates to a self contained breathing apparatus comprising a backpack assembly. The backpack assembly comprises a back frame. A body is mounted to the back frame. The body has an outer periphery defined by an outer periphery of the back frame. The body houses one or more accessories for the backpack assembly and is disposed on an opposite side of the back frame relative to a body of a user of the self contained breathing apparatus. One of the accessories comprises a low air visual alert. In some embodiments, the accessories further comprise a first stage regulator and a power source. In some embodiments, the accessories further comprise a PASS unit, the PASS unit comprising at least one audible alert device and at least one visual alert device. In some embodiments, the accessories further comprise a low air alert device and a low battery alert device. Preferably, at least one audible alert device is located on a first side of the backpack assembly and at least one audible alert device is located on a second side of the backpack assembly where the first side of the backpack assembly being opposite of the second side of the backpack assembly. More preferably, two audible alert devices are located on the first side of the backpack assembly and two audible alert devices are located on the second side of the backpack assembly. The audible alert on the first side of the backpack assembly can be positioned on an upper half of the backpack assembly. The audible alert on the second side of the backpack assembly also can be positioned on an upper half of the backpack assembly. Preferably, at least one of the audible alert devices comprises a bell, a whistle device or a warble whistle.

Some aspects of some embodiments of the present invention involve a backpack assembly for a self contained breathing apparatus. The backpack assembly comprises a back frame that comprises at least one opening formed just inside of a peripheral surface of the back frame. The at least one opening defines a handle that supports about 1000 pounds of load. Preferably, a carabineer attachment point is positioned proximate the handle and the carabineer attachment point is capable of supporting 1000 pounds of load. In some embodiments, the carabineer attachment point is positioned between the at least one opening and the peripheral surface of the back frame.

Some aspects of some embodiments of the present invention also involve a backpack assembly for a self contained breathing apparatus where the backpack assembly comprises a back frame. A tank band assembly is secured to the back frame and the tank band assembly comprises a tank band, a first handle and a second handle. The first handle is coupled to an adjustment mechanism that adjusts a circumference of the tank band and the second handle is connected to the tank band such that the tank band can be opened and closed. In some embodiments, the first handle and the second handle are on opposite sides of a tank. In some embodiments, the second handle comprises a spring loaded cam locking mechanism.

Some other aspects of the present invention relate to a backpack assembly for a self contained breathing apparatus. The backpack assembly comprises a back frame that comprises a rearward surface and a forward surface. The rearward surface and the forward surface are connected by at least one peripheral surface. At least one handle is defined by an opening that is positioned along the peripheral surface. A waist pad is connected to the back frame with a hip plate and the hip plate is connected to a forward surface of the back frame. A shoulder strap is connected to the back frame and a front PASS device is supported by the shoulder strap. The front PASS device is connected by a conduit to an upper housing. The upper housing is mounted to the rearward surface of the back frame. The upper housing comprises a low air audible alarm, a low air visual alarm, a low battery visual alarm and a transducer for a heads-up display. A middle housing is mounted on the rearward surface of the back frame generally below the upper housing. The middle housing comprises a back PASS device. The back PASS device comprises at least one audible alarm device, at least one visual alarm device and at least one firefighter locating beacon. The front and back PASS devices preferably provide two alarms on the front and two alarms on the back such that the PASS devices are not muffled regardless of the positioning of a downed firefighter. A tank band assembly is mounted on the rearward surface of the back frame. The tank band assembly is positioned generally below the middle housing and a tank being mounted within the tank band assembly. A lower housing is mounted on the rearward surface of the back frame. The tank is supported by the lower housing. The lower housing comprises a central power supply and a first stage regulator. A CGA wheel is connected an offset swivel assembly, the offset swivel assembly is connected to a hose and the hose is connected the first stage regulator.

BRIEF DESCRIPTION OF THE DRAWINGS

These and other features, aspects and advantages of certain embodiments of the present invention will become apparent from consideration of the description below, which makes reference to the appended drawings.

DETAILED DESCRIPTION OF THE PREFERRED EMBODIMENT

Figure 1:
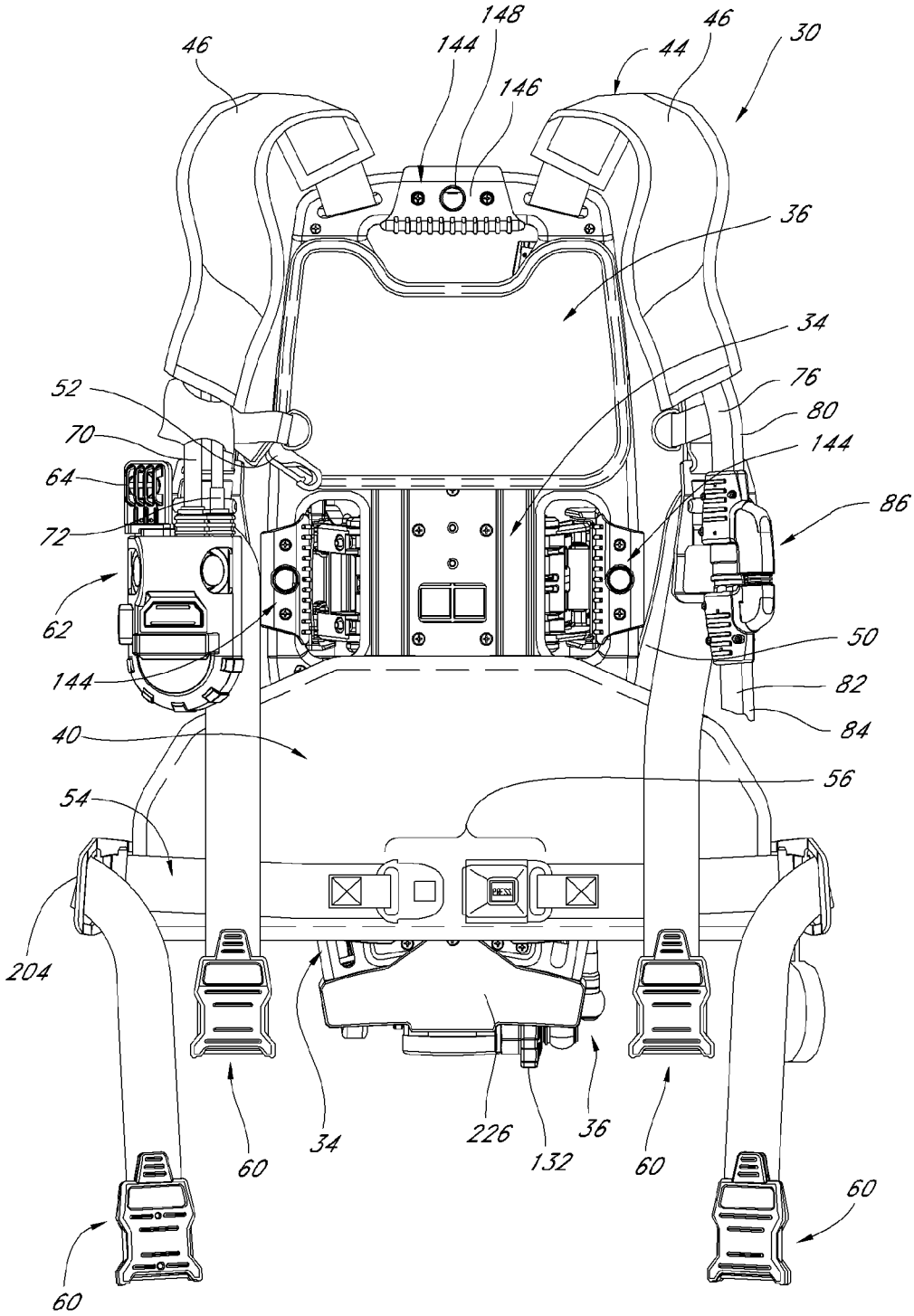
FIG. 1 is a front perspective view of a backpack assembly that is arranged and configured in accordance with certain features, aspects and advantages of the present invention.
Figure 2:
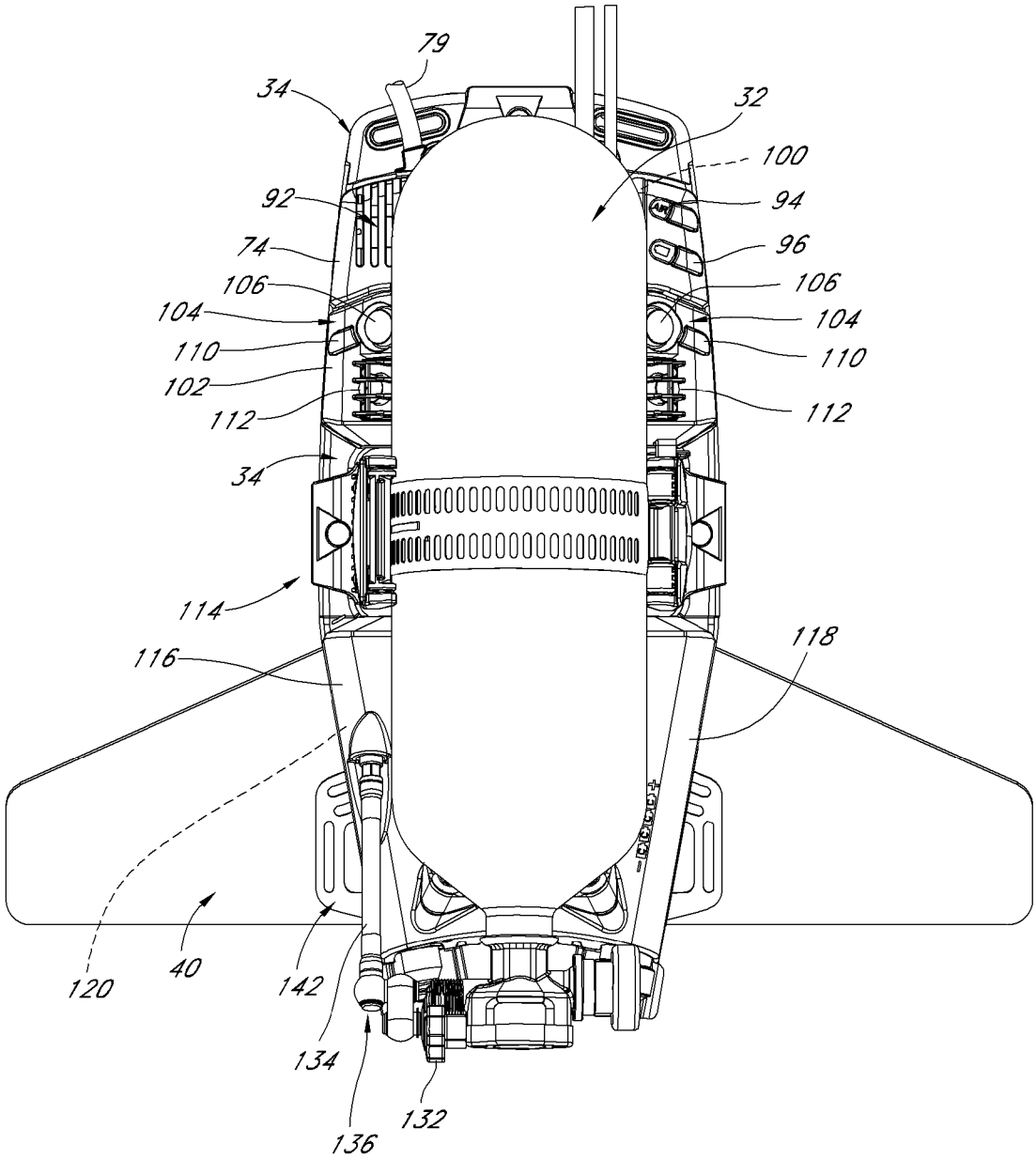
FIG. 2 is a rear perspective view of the backpack assembly of FIG. 1.

With reference initially to FIG. 1 and FIG. 2, a backpack assembly 30 is illustrated therein. The backpack assembly 30 has particular utility with self contained breathing apparatuses but certain features, aspects and advantages of the backpack assembly 30 can be used in other applications. The backpack assembly 30 is shown with an air cylinder or tank 32 supported thereon. While not shown, the backpack assembly 30 can be used with a face piece that, in some embodiments, is provided with a heads up display ("HUD") and a communication system. Any other suitable accessories also can be used.

The illustrated backpack assembly 30 advantageously features several components that have been integrated together to result in a greatly streamlined backpack assembly 30 when compared to prior backpack assemblies that had many components attached along peripheral portions of the backpack assemblies. The components are connected to or disposed in a body formed by several housing assemblies. The streamlined backpack assembly results in reduced snag points. The integrated construction also has been configured to achieve a desirable aesthetic appearance for the backpack assembly 30 and for many of the components of the assembly 30.

Prior to describing the components of the illustrated backpack assembly 30 in detail, the overall construction will be introduced. With reference to FIG. 1, the backpack assembly 30 comprises a back frame 34. The back frame 34 defines a chassis to which the remaining components are assembled. In the illustrated configuration, upper padding 36 is secured to an upper forward portion of the back frame 34. A waist pad 40 is connected to the back frame 34 with a swivel and pivot hip plate 42 (see FIG. 3). The waist pad 40 is positioned generally below the upper padding 36 and also is positioned on a forward surface of the back frame 34. The swivel and pivot hip plate connection provides comfort and ergonomic weight placement in any body position. The connection leads to 35% greater mobility when side bending, up to 30% greater trunk mobility when forward bending and 20% more hip flexion.

A harness 44 also connects to the back frame 34. The harness 44 preferably comprises two shoulder straps 46. Ends of the illustrated shoulder straps 46 are connected to back straps 50 preferably using parachute-style buckles 52. The buckles 52 allow easy release but other types of connections can be used. Lower ends of the back straps 50 can be connected to the hip plate 42. The harness 44 also comprises a waist belt 54, which can comprise two portions that are connected by a buckle 56. The two portions of the waist belt 54 preferably are connected to the waist pad 40 in a manner that will be described below. The shoulder straps 46 and the waist belt 54 can be adjusted using portions that are connected to large hand grabs 60. Preferably, the straps 46, 50, the belts 54, and the pads 36, 40 are easily replaced in the field.

With continued reference to FIG. 1, a front PASS device 62 is supported by the right (as viewed by the user) shoulder strap 46. The PASS device 62 is a personal alert safety system, which is a one-way communications device used by firefighters entering a building to alert others that the wearer of the PASS device 62 is in trouble and in need of rescue. The illustrated PASS device 62 also includes a beacon 64 for a firefighter locating system. The beacon 64 can comprise an omnidirectional ultrasonic transmitter, as will be described in greater detail below.

A pneumatic hose 70 and an electrical cable 72 connect the PASS device to an upper housing 74, which is connected to the upper portion of the back surface of the back frame 34. With reference now to FIG. 2, a second pneumatic hose 76 also is connected to the upper housing 74. With reference again to FIG. 1, the second pneumatic hose 76 extends along a portion of the left shoulder strap 46. A second electrical cable 80 also extends along a portion of the left shoulder strap 46. The second pneumatic hose 76 and the second electrical cable 80 are connected to a third pneumatic hose 82 and a third electrical cable 84, respectively. In the illustrated configuration, a single coupler 86 is used to connect the pneumatic hoses 76, 82 and the electrical cables 80, 84.

The third pneumatic hose 82 extends to a second stage regulator (not shown), which can be positioned along the lower left side of the back frame 34. The second stage regulator (not shown) can be connected to a face mask or the like.

With reference again to FIG. 2, the upper housing 74 in the illustrated configuration contains a low air audible alarm 92, which is positioned to the left side of the upper housing 74. The right side of the upper housing 74 comprises a low air light 94, a low battery light 96 and a HUD transducer 100. The upper housing 74 and the components housed therein will be described in greater detail below.

A middle housing 102 is mounted to the back frame 34 just below the upper housing 74. The middle housing 102 contains one or more back PASS devices 104. Accordingly, the middle housing 102 includes two audible alert devices 106 and two visual alert devices 110. The illustrated middle housing 102 also houses two beacons 112 for the firefighter locating system.

A tank band assembly 114 is mounted to the back frame 34 just below the middle housing 102. The tank band assembly 114 is used to secure the cylinder 32 to the back frame 34. Advantageously, the tank or cylinder 32 is secured in a lower position (e.g., the top end of the tank is below the top end of the back frame). The lower position of the tank helps the tank to rotate away from the leg and hip region of the user, which provides space for less restricted mobility. In addition, the lower position allows that tank to slide over the buttocks during trunk extension. The tank band assembly will be described in greater detail below.

A lower housing 116 is mounted to the back frame 34 just below the tank band assembly 114. The lower housing 116 preferably contains a central power supply 118, which can comprise 4 C-cell batteries in series. The central power supply 118 supplies power to the backpack assembly 30. The lower housing 116 also houses a first stage regulator 120. The first stage regulator 120 can be connected to a removable buddy breather (not shown) by a hose (not shown). A removably coupling can be provided at the end of the hose (not shown) that connects to the lower house 116 such that the buddy breather (not shown) can be removed if desired. In some configurations, the hose (not shown) can be about 36 inches long. Other lengths can be used. The hose (not shown) can be connected to the first stage regulator 120 with a swivel coupling (not shown) that swivels about an axis of the hose (not shown) such that the likelihood of kinking of the hose (not shown) is greatly reduced. The buddy breather (not shown) can be positioned within a pouch (not shown) that can be connected to a left side of the back frame 34.

A CGA wheel 132 can be connected to the first stage regulator 120 with a hose 134. The hose preferably is connected to the CGA wheel 132 with an offset swivel assembly 136, which provides flexibility in locating the CGA wheel 132 such that various valve stem configurations can be accommodated by the backpack assembly 30.

Having introduced a basic construction of the illustrated backpack assembly 30, several of the components will be discussed in greater detail with reference to the drawings of one example of the backpack assembly 30.

Back Frame

Figure 3:
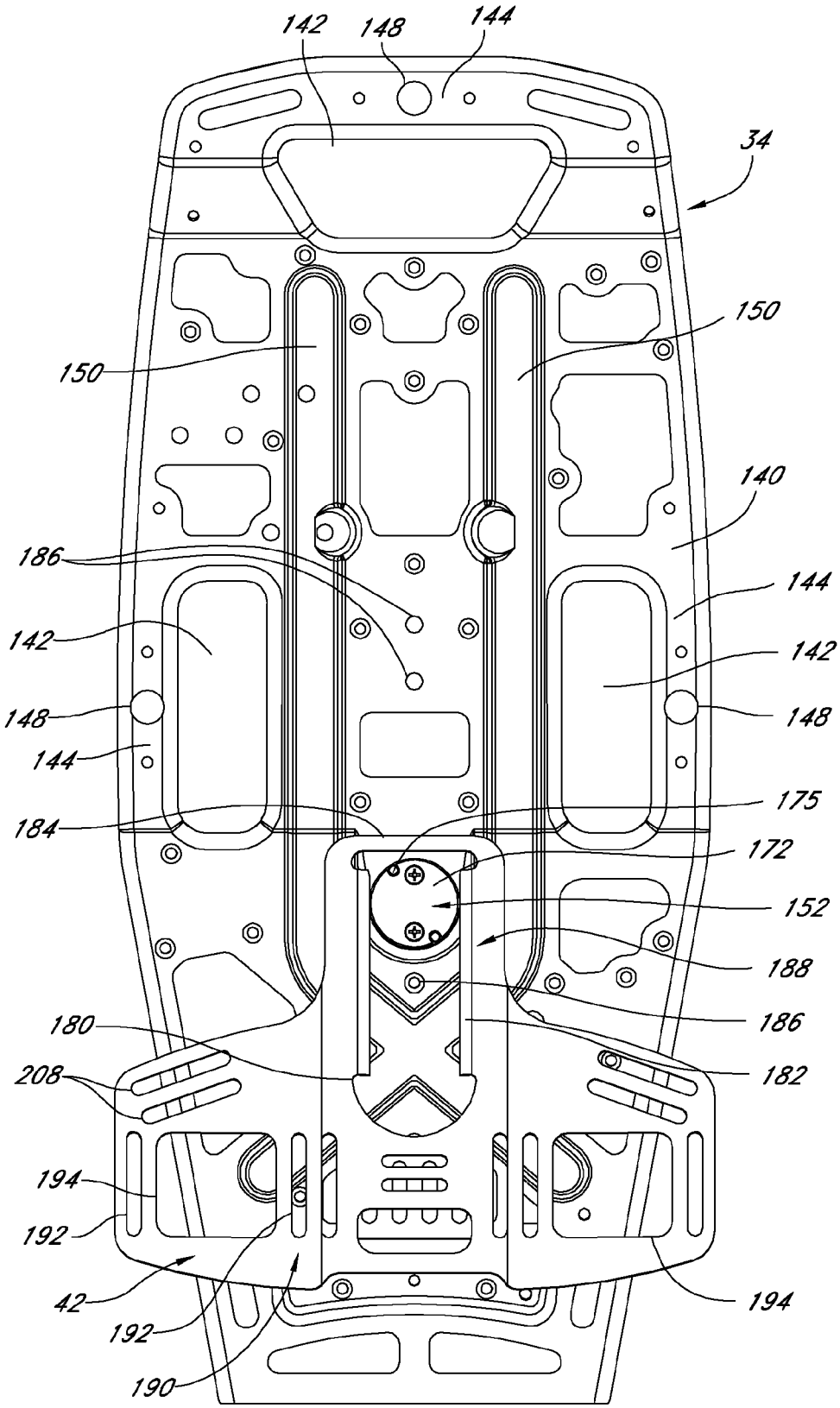
FIG. 3 is a front elevation view of a back frame assembly for the backpack assembly of FIG. 1.

As discussed above, the back frame 34 preferably defines the chassis around which the harness 44 and the balance of the backpack assembly 30 are constructed. With reference now to FIG. 3, the back frame 34 and the articulating hip plate 42 are illustrated.

The illustrated back frame 34 can be formed in any suitable manner. The illustrated back frame comprises a plate member 140. The plate member 140 of the back frame 34 can be formed of any suitable material. In one configuration, the plate member 140 is formed of aluminum. The aluminum back frame 34 provides a lightweight construction with high strength and rigidity. In some embodiments, the back frame 34 can be constructed of suitable tubular components. In either configuration, the back frame 34 defines a suitable platform upon which the balance of the backpack assembly 30 can be mounted or to which the balance of the backpack assembly 30 can be attached.

Figure 4:
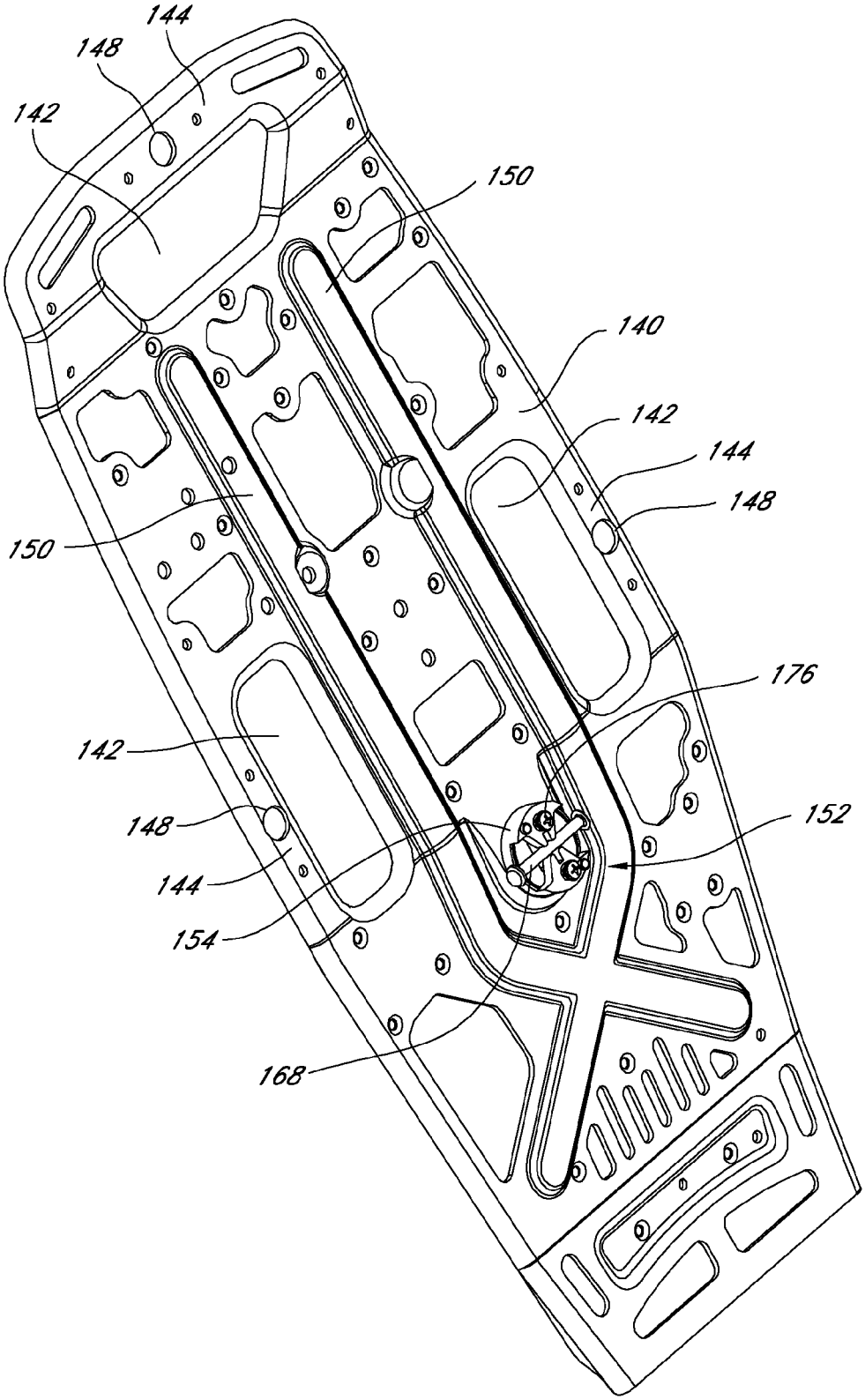
FIG. 4 is a perspective view of a portion of the back frame assembly of FIG. 3.

With reference to FIG. 3 and FIG. 4, the plate member 140 of the back frame 34 comprises one or more handle openings 142. The handle openings 142 help to define handles 144 along the periphery of the plate member 140. In the illustrated configuration, the plate member 140 comprises three openings 142 and three handles 144. The openings 142 and handles 144 in the illustrated configuration are positioned at a top of the plate member 140 and at each lateral side of the plate member 140. The openings 142 and the handles 144 preferably are sized and configured to allow the backpack assembly 30 to be lifted or pulled as desired. In one preferred configuration, the handles 144 are sized and configured to withstand a 1000 pound load (i.e., a 1000 pound drag load). The handles, as shown in FIGS. 1 and 2, preferably also comprise a reinforcing plate 146 that can be secured to the plate member 140 using fasteners or any other suitable technique.

Moreover, in the illustrated configuration, the handles 144 include carabineer attachment points 148. Preferably, each of the handles 144 includes one or more attachment point 148. In some configurations, however, less than all of the handles 144 may include an attachment point 148. The attachment points 148 can be formed in any suitable manner. In the illustrated configuration, each of the attachment points 148 is defined by a hole that extends through the handle 144 and preferably through the associated reinforcing plate 146.

With continued reference to FIG. 3 and FIG. 4, the plate member 140 preferably comprises one or more channel 150. In the illustrated configuration, two channels 150 extend along a substantial portion of the length of the plate member 140. The channels 150 protrude from the front surface of the plate member 140. A lower portion of each of the illustrated channels 150 forms a crossing pattern. In some configurations, a separate channel can be used to connect the two channels 150 that extend in a generally vertical direction. The channels 150 reinforce the plate member 140 and can be used as a conduit of internal wires, cables, hoses or the like.

Hip Plate

With reference now to FIGS. 4 through 12, the hip plate 42 (see FIG. 3) has been removed from the back frame 34 so that a hip plate mounting assembly 152 can be better shown. The mounting assembly 152 advantageously enables the hip plate 42 to articulate relative to the back frame 34. The articulation allows motion between the back frame 34, which is secured to the shoulders when worn, and the hip plate 42, which is secured to the hips and shoulders when worn. In one configuration, the mounting assembly 152 provides some level of movement between back frame 34 and the hip plate 42 while limiting that movement to provide a suitably stiff configuration. Preferably, the hip plate 42 is not capable of substantial lateral movement relative to the back frame 34. More preferably, such lateral motion is significantly restricted with a goal of eliminating lateral motion of a mass associated with the cylinder 32 that is attached to the back frame 34.

The illustrated mounting assembly 152 comprises a bushing 154. The bushing 154 can be formed of any suitable material. In one preferred configuration, the bushing 154 defines means for dampening and limiting rotation within a desired range. Preferably, the bushing 154 is formed of an elastomeric material. More preferably, the bushing 154 is formed of an elastomeric material that can sustain a 500 degrees Fahrenheit flash temperature, a 200 degrees Fahrenheit soak temperature and a temperature of 500 degrees Fahrenheit for 5 minutes. Even more preferably, the bushing 154 is formed of butyl rubber.

Figure 5:
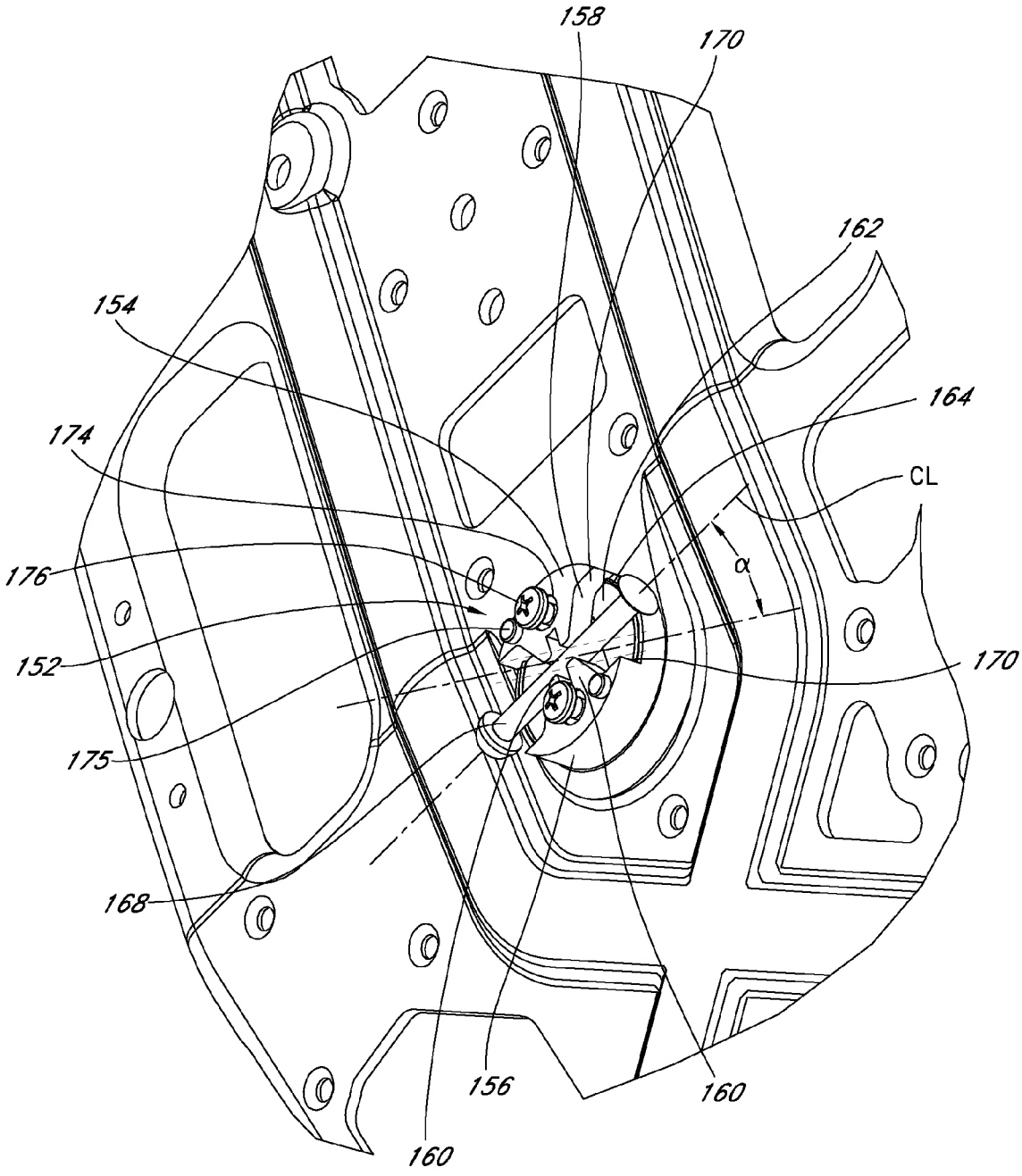
FIG. 5 is an enlarged perspective view of a portion of the back frame assembly of FIG. 3.
Figure 6:
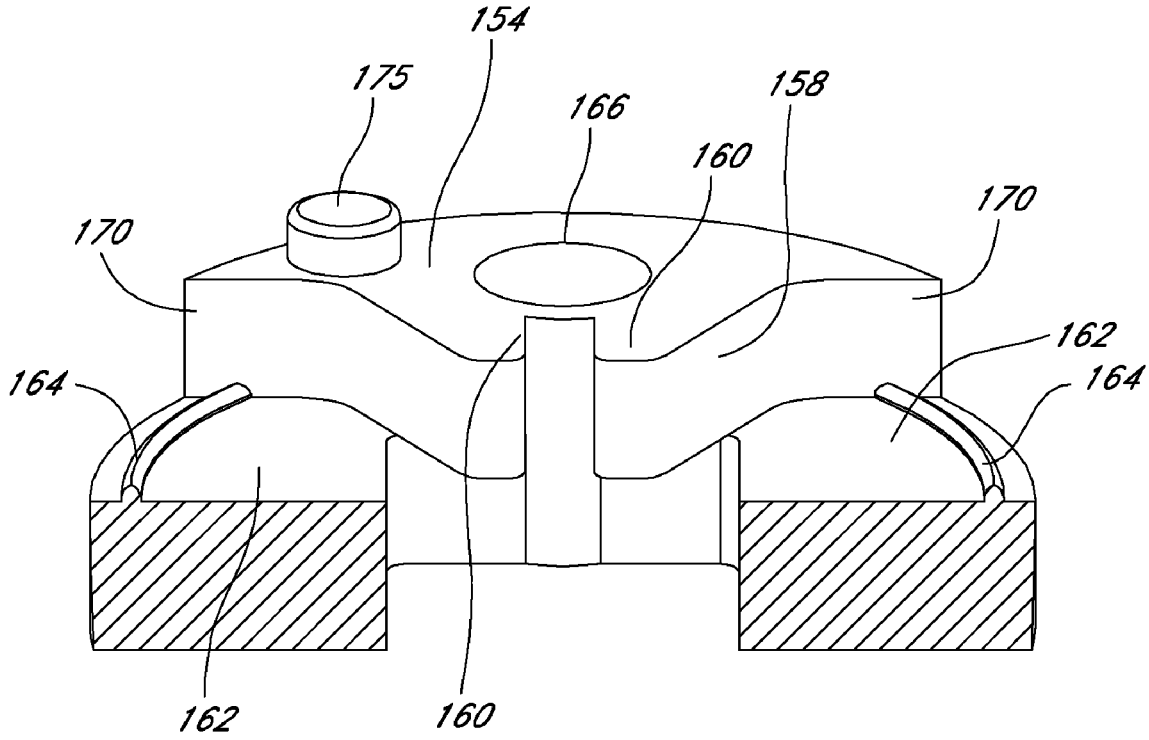
FIG. 6 is sectioned perspective view of a bushing used in the back frame assembly of FIG. 3.
Figure 7:
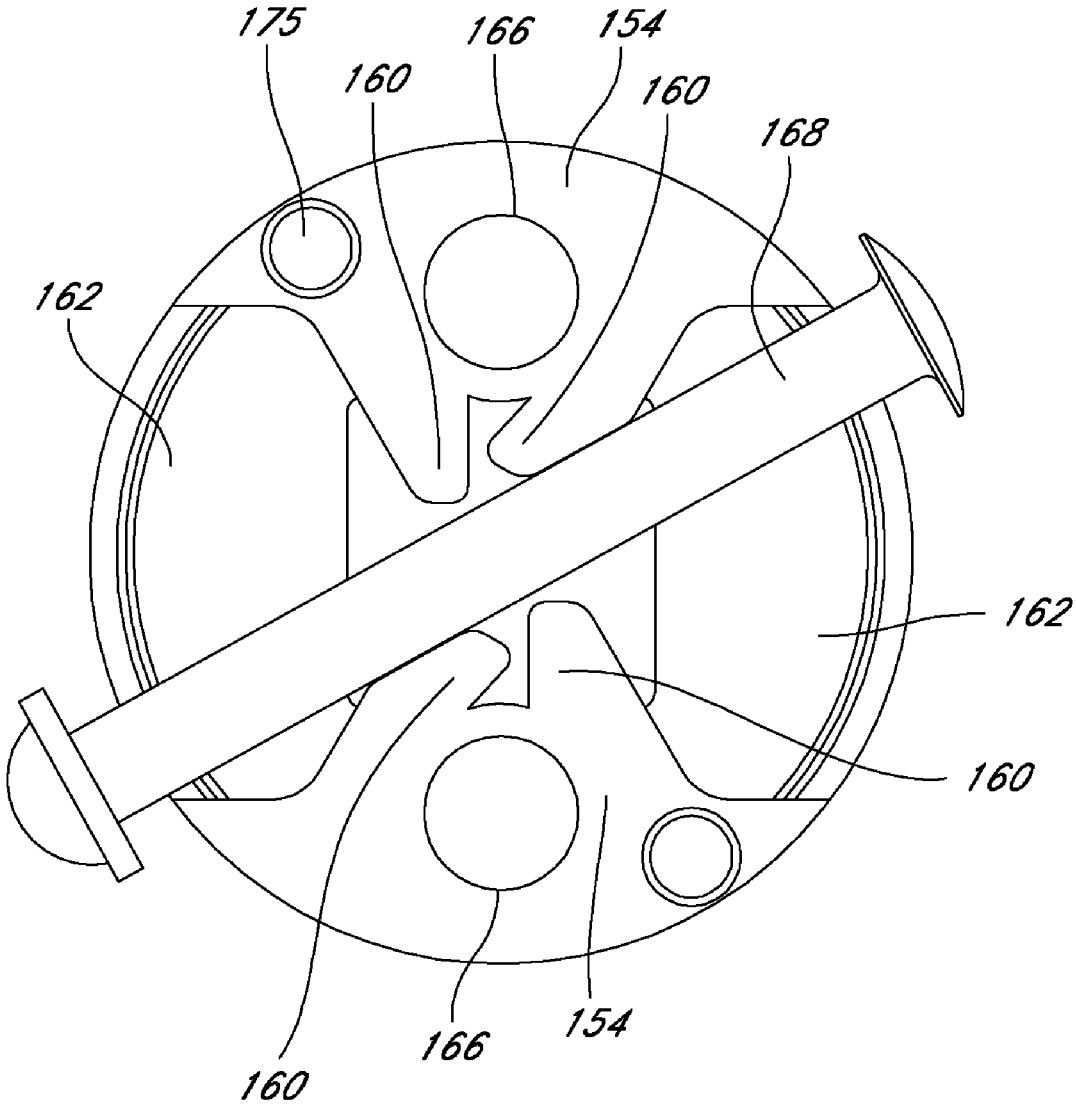
FIG. 7 is a perspective view of the bushing and a pin used in the back frame assembly of FIG. 3.

The illustrated bushing 154 preferably comprises a generally cylindrical outer surface 156 (see FIG. 5). The illustrated bushing 154 also preferably comprises a pair of inner contoured surfaces 158, one of which is shown in the cross-section of FIG. 6. Each of the contoured surfaces 158 in the illustrated configuration defines two fingers 160, which will be discussed in greater detail below. The contoured surfaces 158 also advantageously define a lower stepped region 162. A ridge 164 also can be defined along a portion of each of the stepped regions 162. The fingers 160 preferably extend over a portion of the thickness of the bushing 154 while the stepped regions 162 extend over a balance of the thickness of the bushing 154. In other words, in the illustrated embodiment, the stepped regions 162 and the fingers 160 together extend over substantially the entire thickness of the bushing 154.

The bushing 154 also preferably comprises a pair of mounting holes 166. The mounting holes 166 in the illustrated configuration extend through the entire thickness of the bushing 154. Other configurations are possible.

With reference to FIG. 5, a pin 168 preferably extends through a recess defined by the stepped regions 162. The pin 168 comprises a centerline CL. The centerline CL preferably is able to sweep through an included angle $\alpha$ of about 30 degrees in each direction relative to a centered position. In other words, a total sweep of about 60 degrees is possible by the pin 168.

As shown, the fingers 160 extend toward the pin 168. The pin 168 preferably is contacted by the fingers 160 in four places. Other configurations are possible. The illustrated configuration, however, provides an unbiased yet stable hold on the pin 168 by the bushing 154. Advantageously, the fingers 160 are able to flex (see FIG. 7) when the pin 168 sweeps through all or at least a portion of the full sweep. By flexing, the fingers 160 dampen the movement of the pin 168, and thereby dampen the movement of the hip plate 42 relative to the back frame 34. The flex of the fingers 160 also helps to return the pin 168 to a neutral position, which is generally horizontal in the illustrated configuration.

The full sweep angle preferably is defined, at least in part, by an outer portion of the contoured surfaces 158. In other words, portions of the contoured surfaces 158 define stops 170. The stops 144 preferably come into contact with the pin 168 at the limit of the sweep. Other configurations to limit the sweep of the pin 168 also are possible.

With reference now to FIGS. 4 and 5, the bushing 154 preferably is sandwiched between the plate member 140 and a bushing plate 172. The bushing plate 172 preferably is formed of a suitably rigid material. In one embodiment, the bushing plate 172 is formed of aluminum. Other materials also can be used. The bushing plate 172 preferably has a diameter that is slightly less than a diameter of the bushing 154.

The bushing plate 172 can be secured to the plate member 140 by suitable fasteners. In one configuration, two standoffs 174 are secured to the plate member 140. The standoffs 174 can be formed of any suitable material. In the illustrated configuration, the standoffs 174 are formed of stainless steel. The standoffs 174 extend at least partially through the mounting holes 140 of the bushing 154. In one embodiment, the standoffs 174 extend fully through the bushing 154. The bushing plate 172 can be secured to the standoffs 174 by screws 176 or other suitable fasteners. Preferably, the bushing plate 172 moderately squeezes the bushing 154 when mounted to the plate member 140.

In the illustrated embodiment, one or more bosses 175 extend from the surface of the bushing 154. The bosses 175 can be integrally formed with the bushing 154. The bosses 175 are used in conjunction with corresponding slots or recesses 177 formed in the bushing plate 172 as alignment aids during manufacturing. Other techniques also can be used.

The pin 168 also preferably is compressed between the bushing 154 and the bushing plate 172. The compression of the pin 168 advantageously provides a small degree of resistance in the mounting assembly 152 such that the mounting assembly 152 is less likely to rattle significantly.

Figure 8:
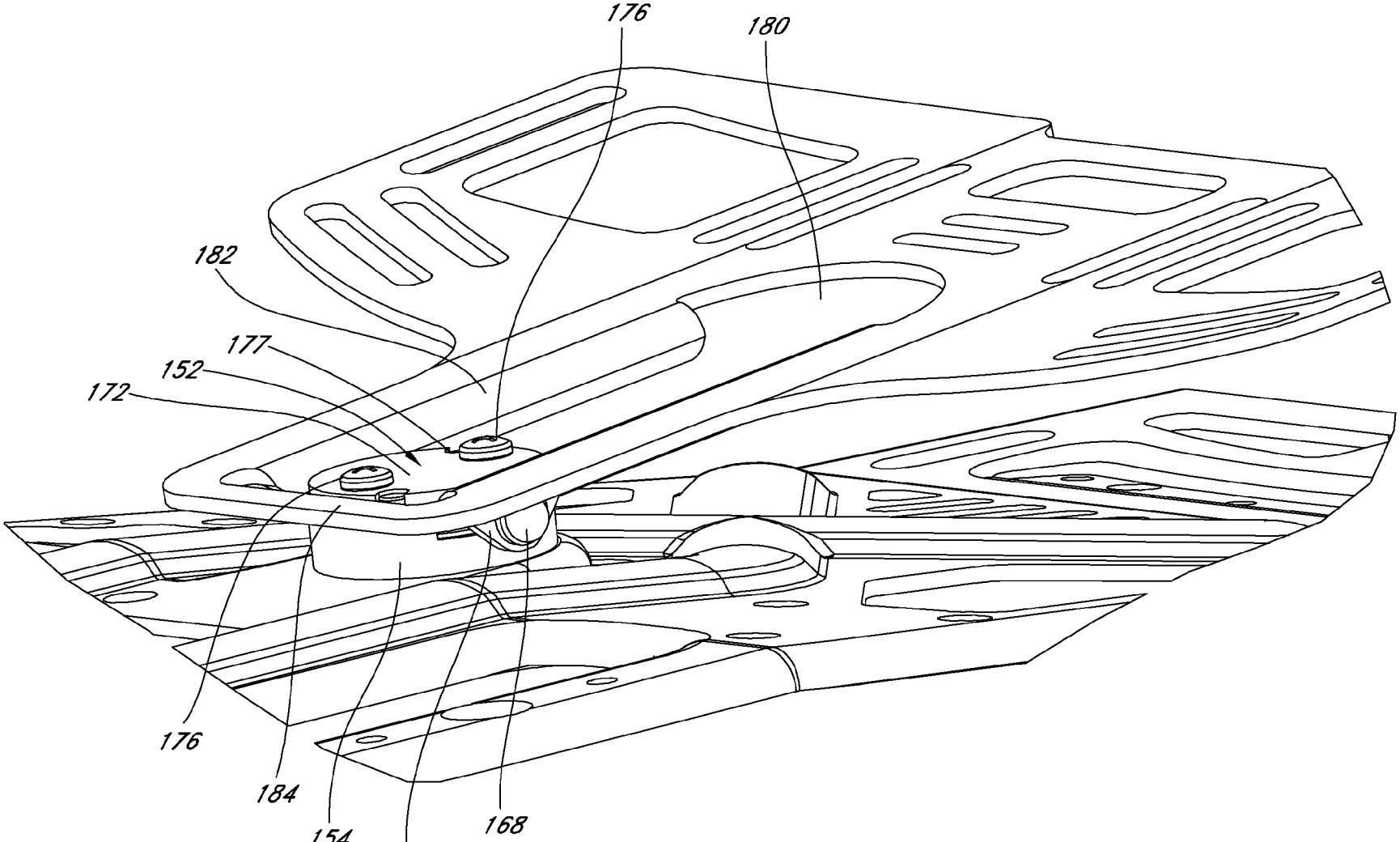
FIG. 8 is a perspective view of a portion of the back frame assembly of FIG. 3.
Figure 9:
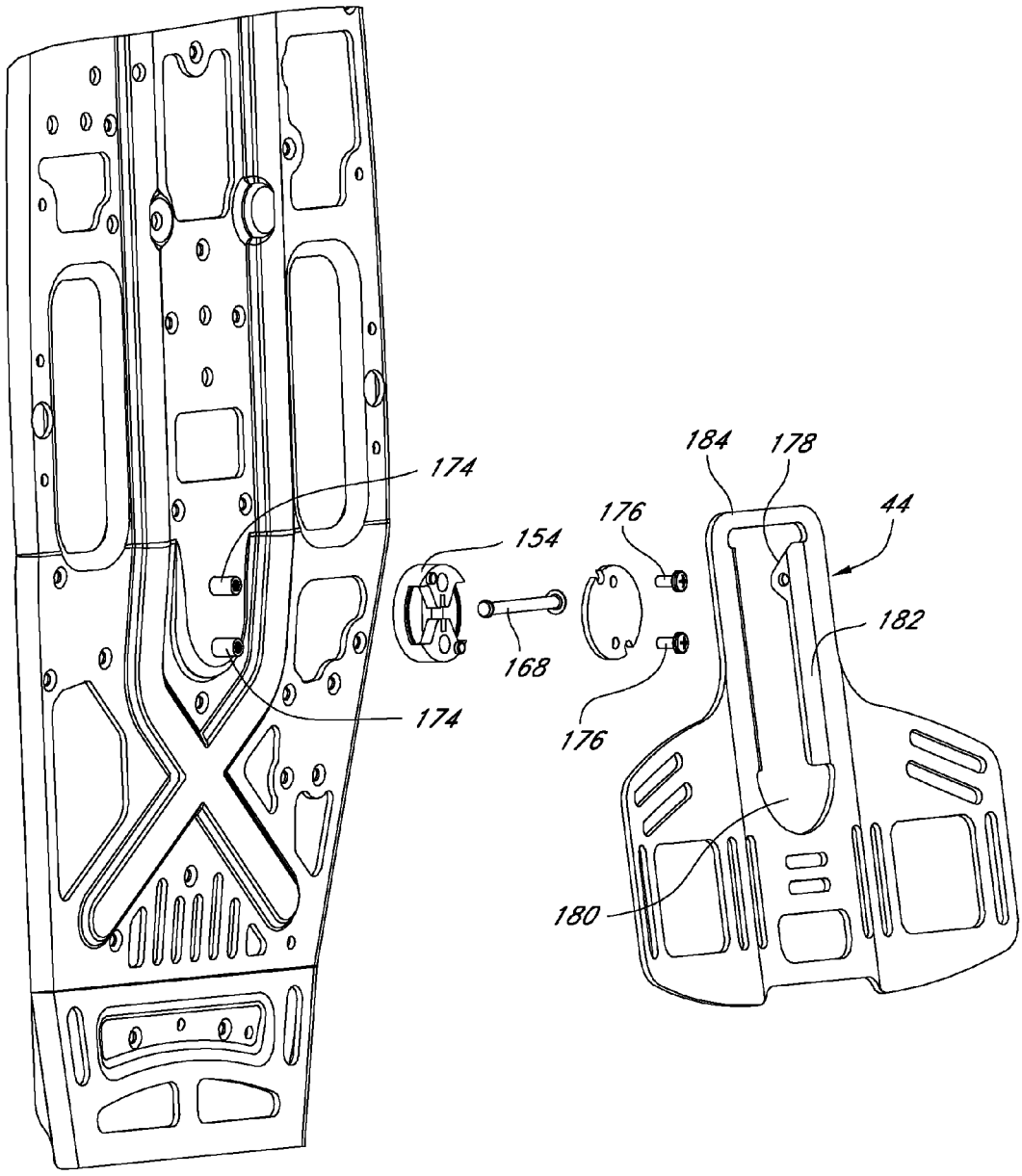
FIG. 9 is an exploded perspective view of the back frame assembly of FIG. 3.

With reference to FIG. 8, the hip plate 42 comprises two mounting ears 178. The mounting ears 178 can be integrally formed with the hip plate 42 or can be separately formed from the hip plate 42 and secured to the hip plate 42 in any suitable manner. The pin 168 extends through the ears 178 such that the pin 168 pivotally secures the ears 178, and therefore, the hip plate 42, to the mounting assembly 152. In one embodiment, the pin 168 is a rivet. Other types of pins also can be used.

The ears 178 extend alongside a portion of the bushing 154. Preferably, the ears 178 do not extend so far alongside the bushing 154 that they come into contact with the plate member 140. Because the bushing plate 172 is slightly undersized relative to the bushing 154, slight movement of the hip plate 42 in a manner that causes either the left ear or the right ear of the ears 178 to move toward the plate member 140 relative to the other of the ears 178 will cause one or both of the ears 178 to rub against the bushing 154 rather than the bushing plate 172, which reduces premature wear of the metal members (i.e., the bushing plate 172 and the ears 178) and reduces rattling.

With reference again to FIG. 3, the hip plate 42 comprises an enlarged central opening 180. The enlarged central opening 180 in the illustrated configuration comprises two opposing rolled edges 182, which reinforce the hip plate 42. The mounting ears 178 can be integrally formed with the rolled edges 182 in some configurations. The enlarged central opening 180 also comprises a header 184, which extends across the top of the opening 180. Preferably, the enlarged central opening 180 generally surrounds the mounting assembly 152.

Figure 10:
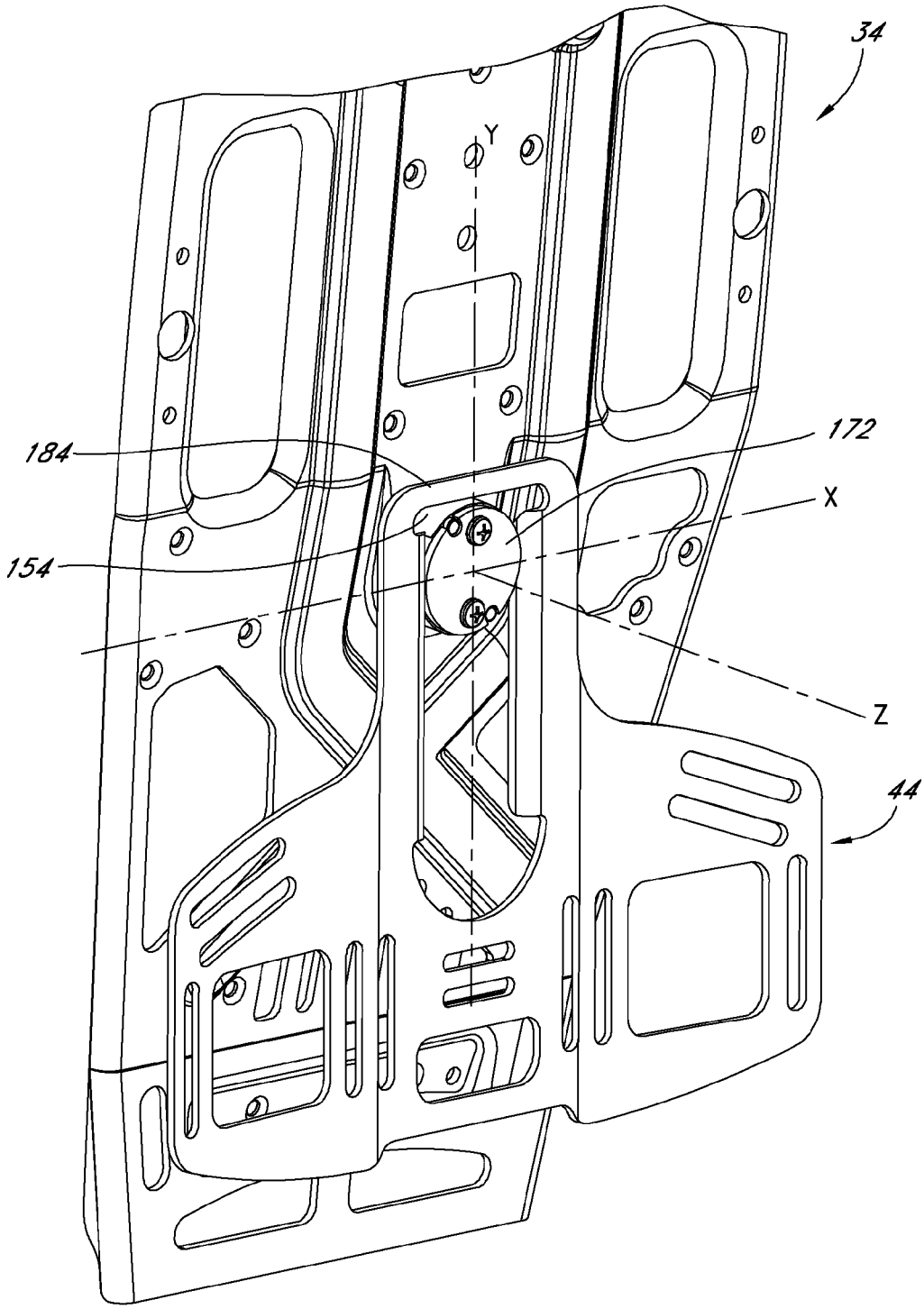
FIG. 10 is an enlarged perspective view of a portion of the back frame assembly of FIG. 3 in which an ordinate system is introduced.

With reference to FIG. 10, the bushing 154, through resistance to compression loads, allows very limited rotation of the hip plate 42 about a Y-axis. This rotation about the Y axis also is greatly limited by the ears 178 that contact the sides of the bushing 154. By reducing and/or eliminating the movement about the Y axis, a sensation of stability is provided to the user.

Figure 11:
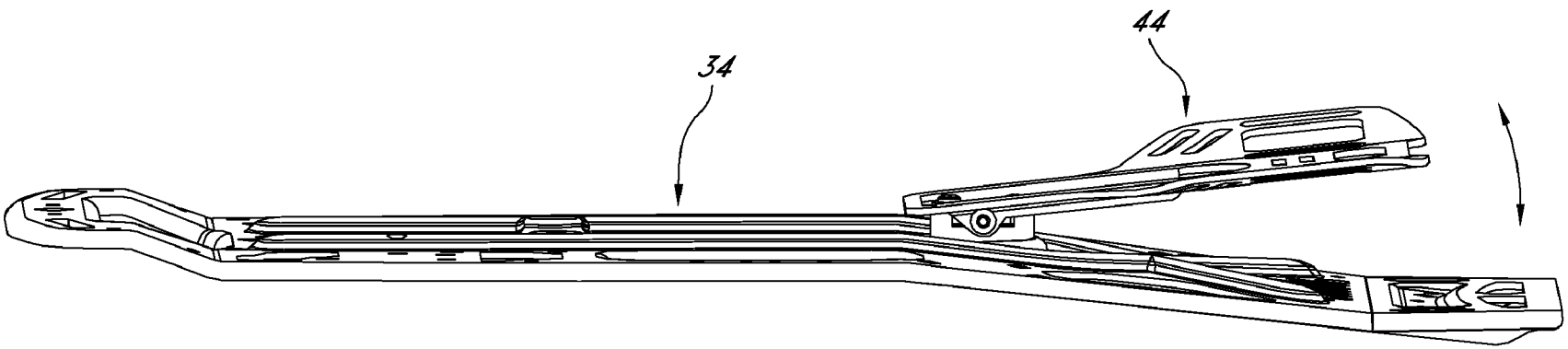
FIGS. 11 and 12 show a hip plate of the back frame assembly of FIG. 3 in two different modes of movement.
Figure 12:
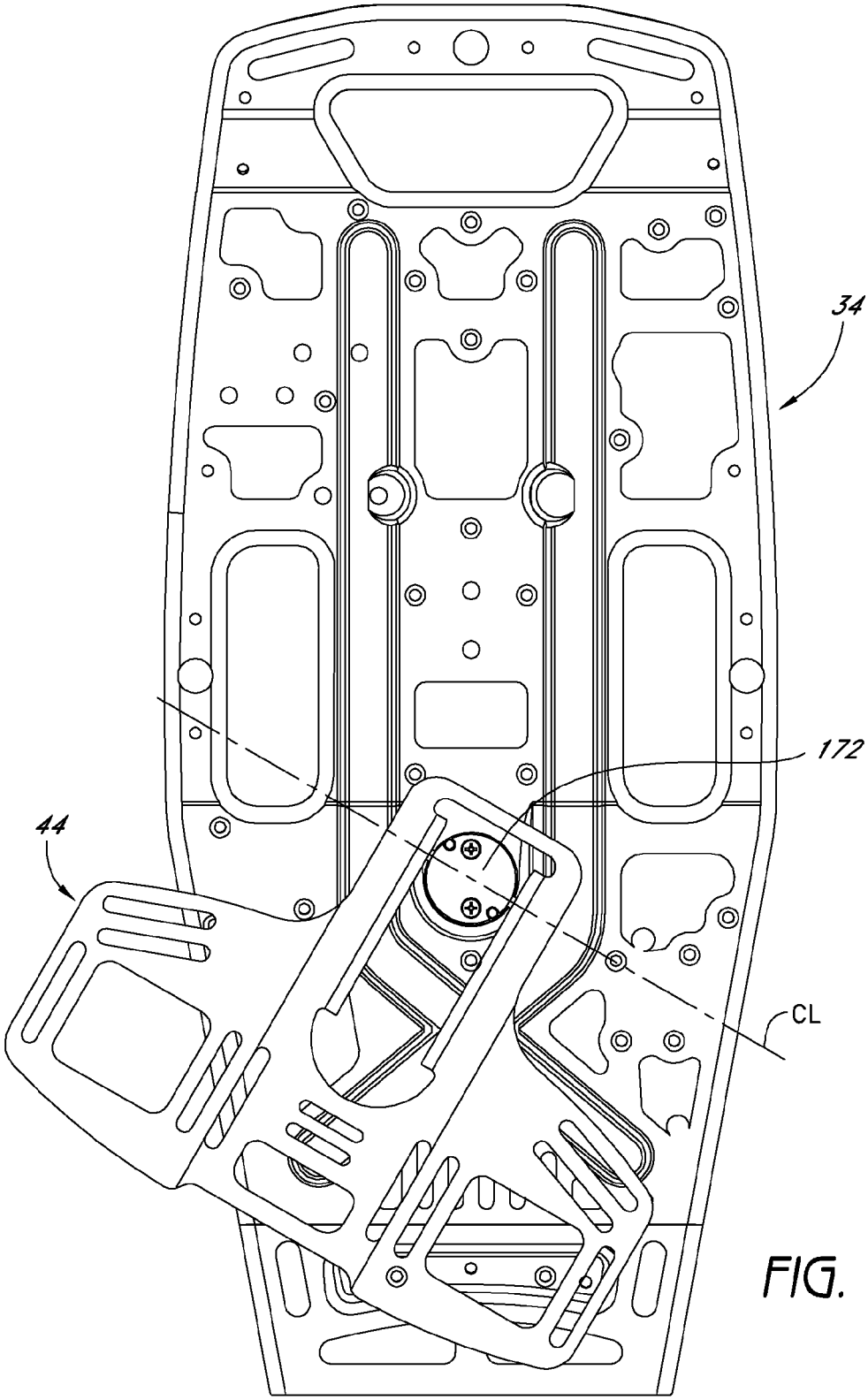

The hip plate 42 can move relative to the plate member 140 about the X-axis (see FIG. 11). The movement of the hip plate 42 about the X axis generally is limited by the header 184 of the hip plate 42. The header 184, or another upper portion of the hip plate 42, can contact either the bushing 154 or the plate member 140 in the illustrated configuration. Thus, the hip plate 42 can move relative to the plate member 140 in a limited range about the X axis.

The hip plate 42 is able to rotate about the Z-axis in the manners described above (see FIG. 12). The movement of the hip plate 42 is limited by the interplay between the pin 168, the fingers 160 and the stops 170. As described above, the fingers 160 are designed to easily collapse when the pin 168 rotates off center about the Z axis. When the fingers 160 collapse, the fingers 160 allow a natural and minimally restrictive movement of the pin 168. When not being worn, the fingers 160 generally return the hip plate 42 to a neutral position, which assists the user when putting on the backpack assembly 30. In addition, as discussed above, the stops 170 limit the range of rotation about the Z axis.

With reference again to FIG. 3, the plate member 140 preferably comprises a plurality of mount holes 186. The plurality of mount holes 186 allows the position of the mounting assembly 152 to be moved upward or downward along the plate member 140. In the illustrated configuration, the middle two of six mount holes 186 have been used to mount the mounting assembly 152. Providing the plurality of mount holes 186 allows a single plate member 140 to be used while allowing some customization of sizing to accommodate various body structures of the end users. For instance, at least three different hip plate mounting locations are provided in the illustrated configuration. Thus, some configurations provide customization among a small, a standard and a large configuration to accommodate varied body sizes for the end users.

With continued reference to FIG. 3, the illustrated hip plate 42 comprises an inverted generally T-shaped configuration. The mounting assembly 152 advantageously is located proximate an upper portion 188 of the hip plate 42, while the base 190 of the hip plate 42, which is adapted to rest in the hip region of an ultimate user, is positioned lower than the mounting assembly 152. In some configurations, a hip plate 42 with an elongated upper portion 188 can be used in addition to, or as an alternative to, the plurality of mount holes 186. In other words, an elongated upper portion 188 can be used to accommodate a user with a longer torso.

Figure 13:
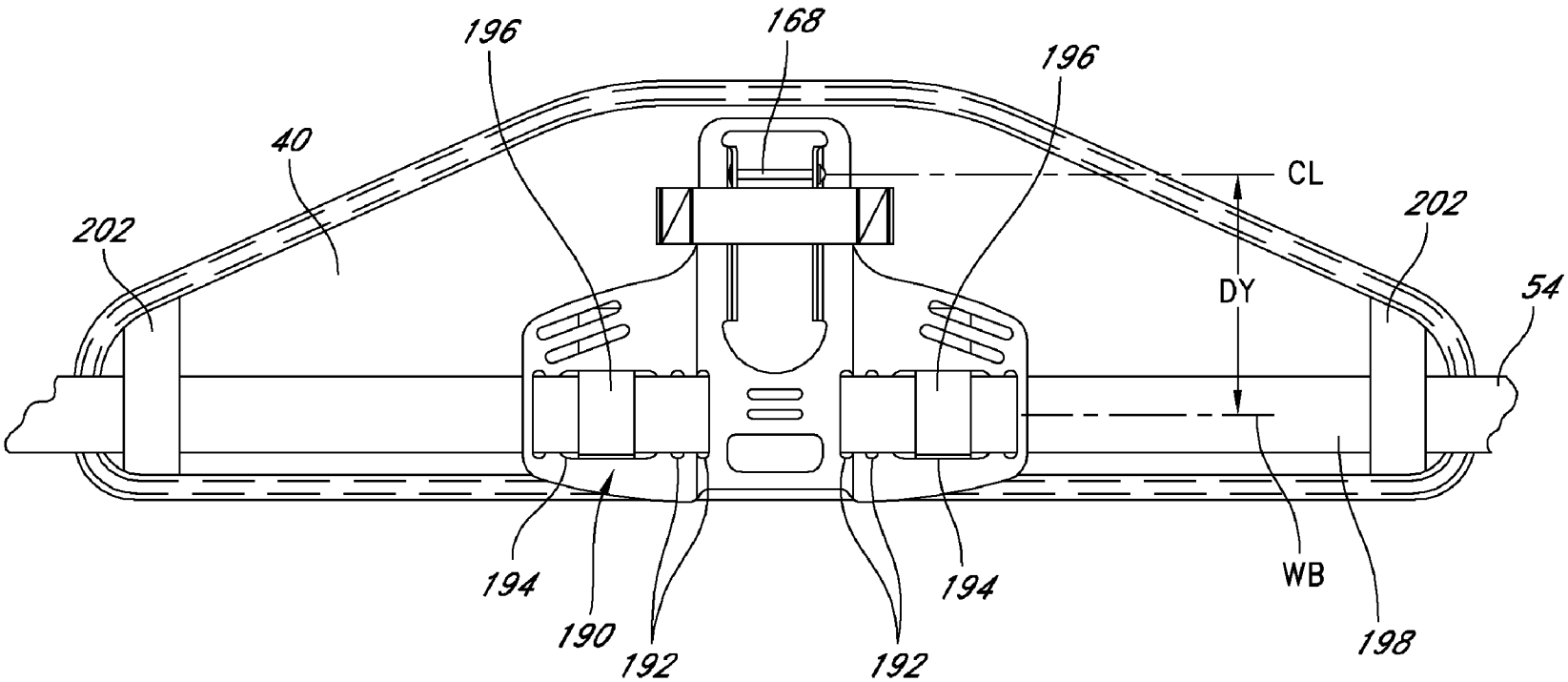
FIG. 13 is a view of the hip plate being connected to a hip/waist pad assembly.

With reference to FIG. 13, the pivot point (i.e., the pin 168) preferably is spaced apart from a center WB of the waist belt 54 by a suitable distance DY. Locating the pin 168 above the center WB of the waist belt 54 creates a small concave pocket in the user's back when the user bends over, which provides increased comfort for the user. The pocket also reduces the amount of shoulder strap restriction experienced by the user. Moreover, by lengthening the distance DY between the waist belt center WB and the pivot point 168, the top of the air cylinder 32 can lie generally flat against the top of the back, which provides the lowest possible profile when a user is crawling.

Harness

With continued reference to FIG. 13, the base 190 of the hip plate 42 preferably comprises a plurality of belt apertures 192. The belt apertures 192 are sized and configured to accept suitable webbing or the like. In the illustrated configuration, the hip plate 42 also comprises two enlarged windows 194. The windows 194 provide access to loops 196 formed on the waist pad 40, as will be explained below. As will be appreciated, a coupler belt 198 extends through the lower belt apertures 192 and through the loops 196, which will be positioned in the region of the windows 194. The coupler belt 198 can be joined to the waist belt 54 with D rings or the like.

The waist pad 40 also comprises an upper loop 200. The upper portion 188 of the hip plate 42 is inserted into the upper loop 200. With the upper portion 188 inserted in the upper loop 200, the coupler belt 198 is passed through the outer belt aperture 192 at one side of the hip plate 42. The coupler belt 198 then is passed through the first waist strap loop 196, which generally is positioned in the region of the window 194. The coupler belt 198 then is passed through the central belt apertures 192 prior to being passed through the second loop 196, which also generally is positioned in the region of the other window 194. Finally, the coupler belt 198 is passed through the other outer belt aperture 192. In this manner, the waist pad 40 can be mounted to the hip plate 42.

The coupler belt also passes through outer loops 202 prior to being passed through the D-ring or other suitable coupler plate 204 (see FIG. 1) and being doubled back on itself. Each lateral end of the coupler belt 198 can extend through the coupler plate 204. The coupler plates 204 can be used to connect the waist belt 54 to the coupler belt 198. In one preferred configuration, each end of the coupler belt 198 folds back upon itself and is secured thereto with a belt button 206. The belt button 206 preferably comprises two portions that can be threaded together such that the coupler belt 198 is removably secured in position. Such a configuration enhances the ability to service the backpack assembly 30 in the field. For example, the waist pad 40 can be readily removed and replaced with a coin or screwdriver.

The hip plate 42 also preferably comprises back strap apertures 208. The back straps 50 can be secured to the hip plate 42 through the back strap apertures 208 in any suitable manner.

Preferably, at least the webbing used for the back straps 50 and the webbing used for the waist belt 54 is color coated on one side. In other words, the two sides of the strap have different appearances from each other. The color coating enables twists in the belts and straps to be quickly identified. The color coating can be provided by using a spray on coating or the like. Preferably, the coating is fire retardant. More preferably, the coating stiffens the webbing. In some configurations, the color coating can be woven or silk screened. Other manners of providing webbing that has a color marking on only one side or different color marking on opposing sides also can be used.

Hand Grabs

At the end of the back straps 50 and at the ends of the waist belt 54 are the oversized hand grabs 60. The hand grabs 60 provide a tactile confirmation as well as a visual confirmation that the backpack assembly 30 has been properly put on. Moreover, the oversized hand grabs 60 improve the grip of a gloved hand while putting on the backpack assembly 30.

Figure 20:
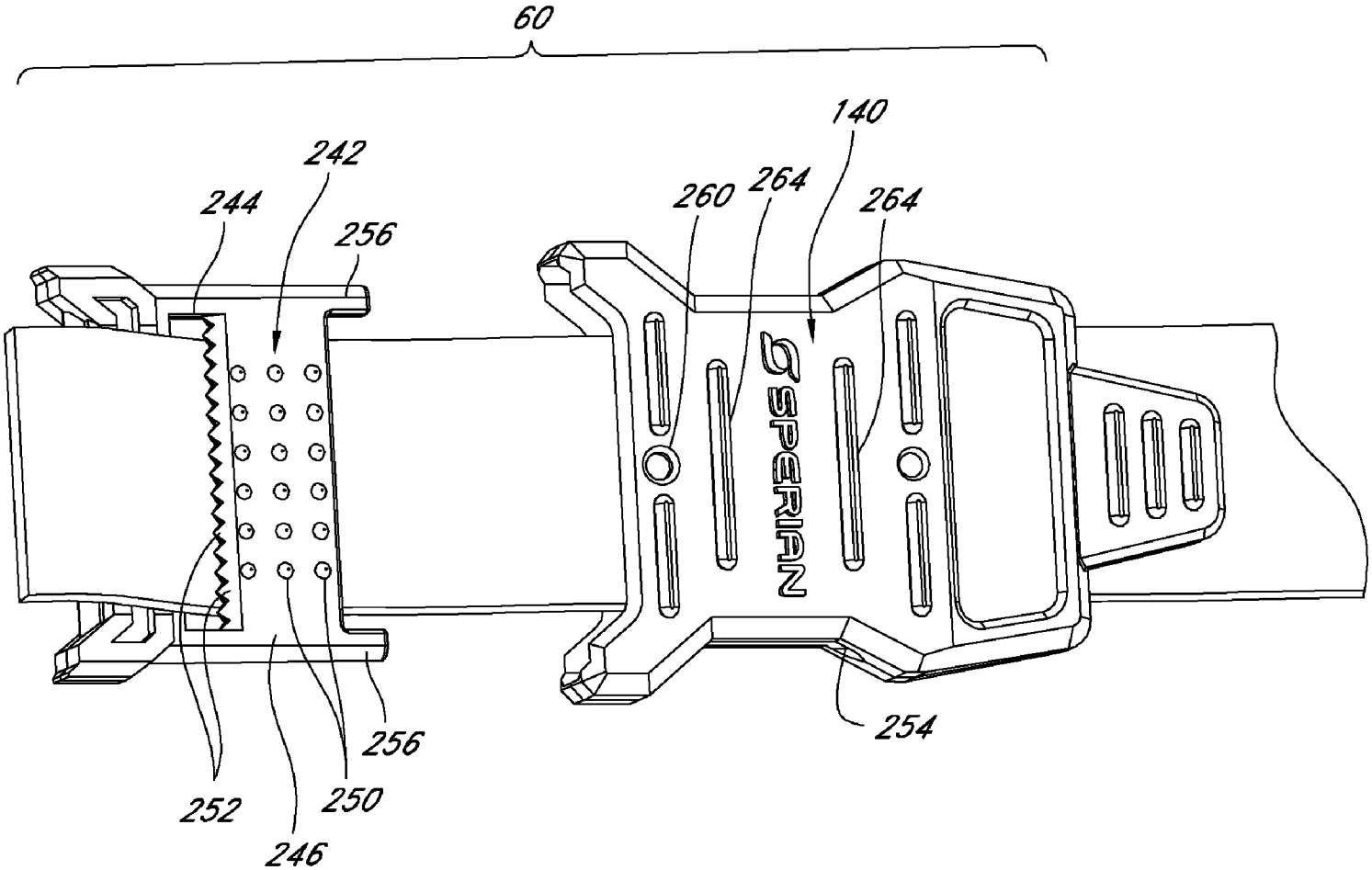
FIGS. 20 and 21 are views of grabs used in the backpack assembly of FIG. 1.
Figure 21:
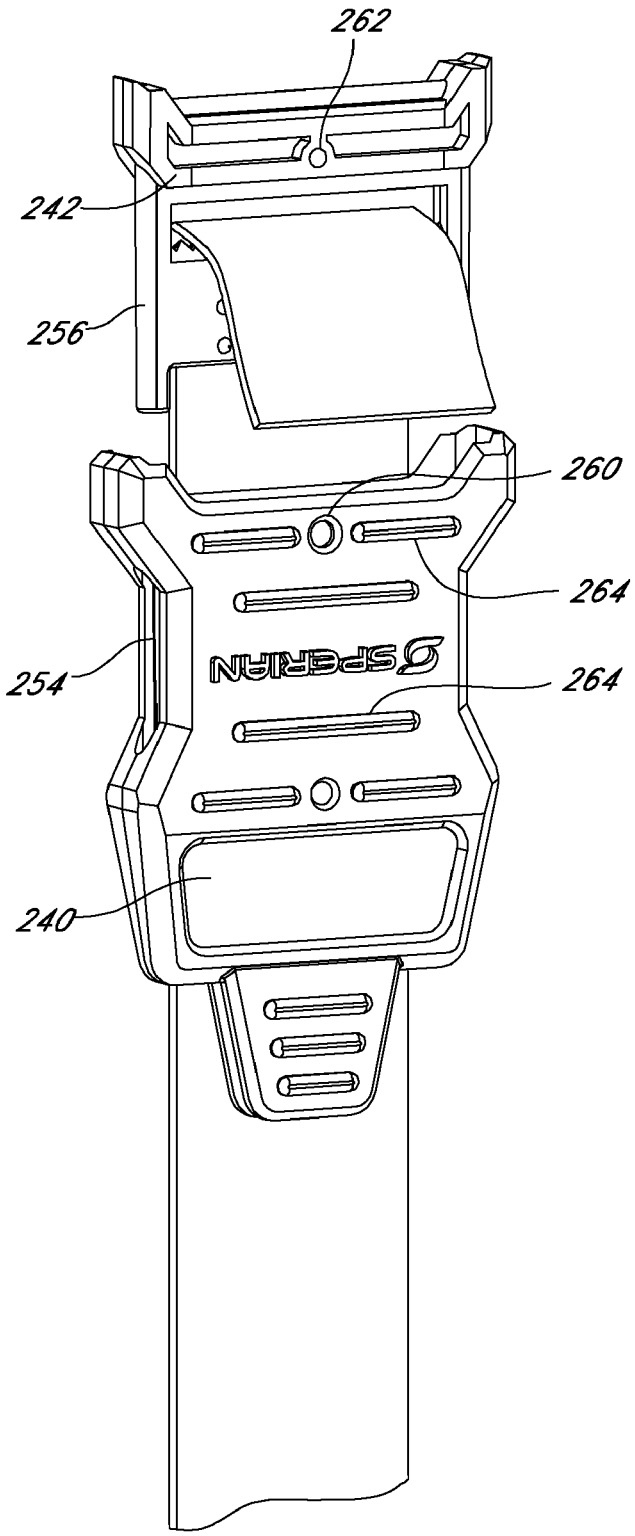

With reference now to FIG. 20 and FIG. 21, the hand grabs 60 preferably comprise a two-piece construction. The illustrated hand grabs 60 comprise a sleeve 240 and an insert 242. The sleeve 240 preferably comprises a passage through which an end of a belt or strap can be threaded. The insert 242 preferably comprises a pseudo-D-ring construction with a passageway 244 defined through a tab 246. The tab 246 preferably comprises studs 250 on each side with serrated teeth 252 positioned within the passageway 244. Other grabbing structures can be used.

The end of the belt or strap can be threaded trough the passageway 244 and folded back over the tab 246. With the end of the belt or strap folded over the tab 246, the insert 242 is pulled back into the sleeve 240 such that the belt or strap is locked in position relative to the insert 242 and the sleeve 240.

With continued reference to FIG. 20 and FIG. 21, the sleeve 240 preferably comprises two lateral slots 254 and the insert 242 preferably comprises two posts 256 that, when the insert 242 is positioned in the sleeve 240, extend laterally outward through the slots 254. These posts 256 reinforce the hand grabs 60 and provide structure that can be used to guide the insert 242 fully into the sleeve 240.

In one configuration, the insert 242 can be snap fit into the sleeve 240. In the illustrated construction, a hole 260 in the sleeve 240 can align with a hole in the insert 242 such that a threaded fastener of the like can be passed into the hole in the insert through the hole 260 and can be used to secure the insert 242 within the sleeve 240. Other configurations also can be used.

The hand grabs 60 can have any suitable external appearance. In one configuration, a plurality of ribs 264 is provided to enhance the ability of a user to grip the hand grabs 60 with a gloved hand. Other configurations also can be used.

Upper Housing

Figure 14:
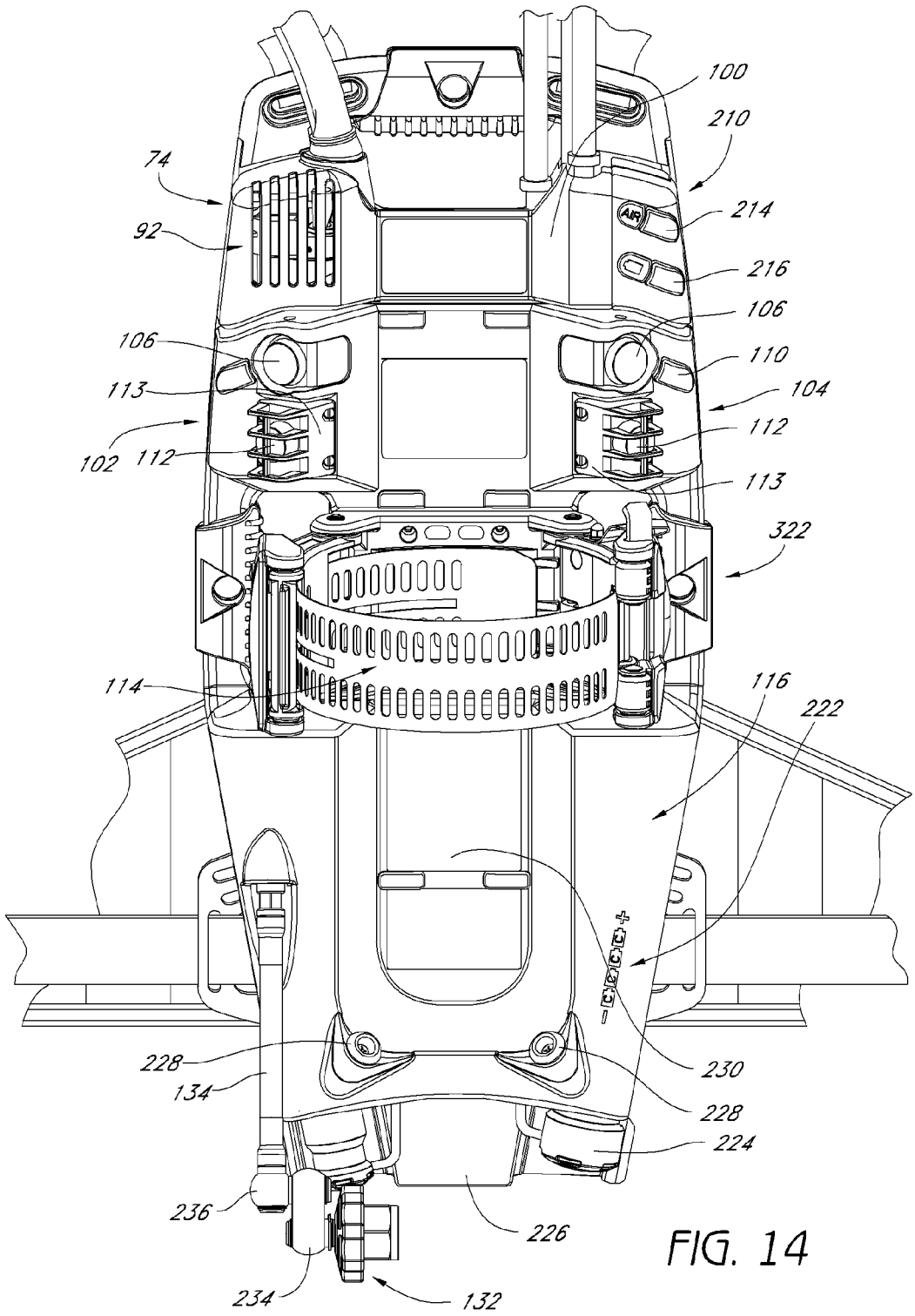
FIG. 14 is a top down perspective view of the backpack assembly of FIG. 1.

With reference now to FIG. 14, a rear perspective view of the backpack assembly 30 is presented with the tank removed for improved clarity. As shown in FIG. 14, the upper housing 74 is provided proximate a top portion of the plate member 140. The upper housing 74 in the illustrated configuration houses a heads up display transducer 100, alert lights 94, 96 and an audible alarm 92.

Figure 15:
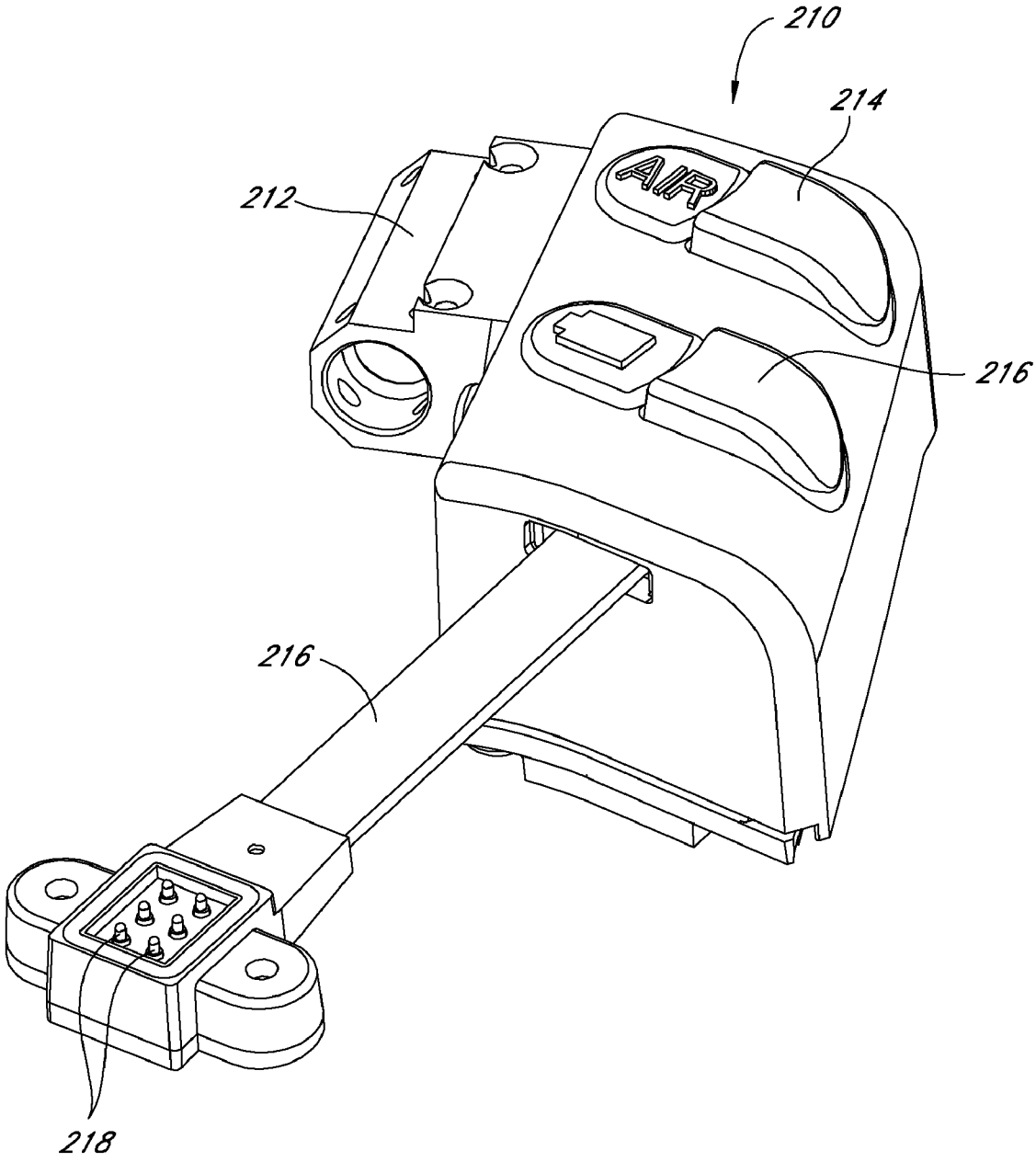
FIGS. 15 and 16 are perspective views of a heads up display transducer housing that is used in the backpack assembly of FIG. 1.
Figure 16:
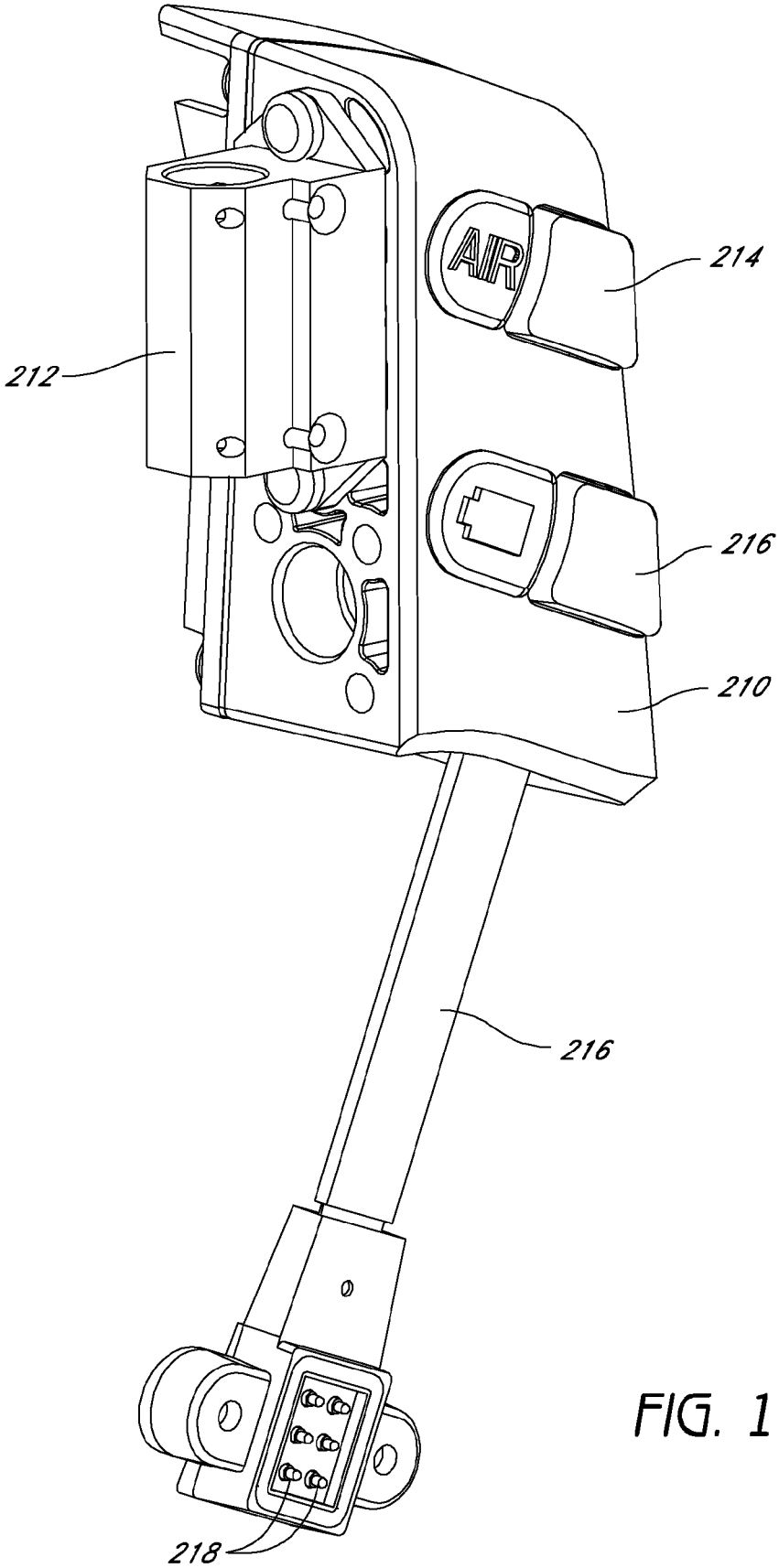

With reference to FIGS. 14-16, the HUD transducer 100 preferably is positioned within a HUD transducer housing 210. The HUD transducer housing 210 preferably comprises a manifold 212. The HUD transducer 100 is in fluid communication with the manifold and is in electrical communication with a printed circuit board (not shown) or the like. The HUD transducer housing 210 also comprises a low air LED (not shown) and a low air LED cover 214. The HUD transducer housing 210 also comprises a low battery LED (not shown) and a low battery LED cover 216. Thus, the HUD transducer housing 210 contains visual alarms for both a low battery condition and a low air condition. For low air supply conditions (e.g., less than about ¼ tank), the audible alarm 92 can emit an audible alert. For instance, a bell, a whistle, a warble whistle or the like can be emitted. In addition, the low air LED, which is positioned below the low air LED cover 214, preferably flashes at a first rate when a first level of air (e.g., ¼ tank) is detected and preferably flashes faster when a second level of air, which is lower than the first level or air, is detected (e.g., 1/10 tank).

The circuitry contained with the upper housing 74, and more specifically the HUD transducer housing 210, monitors battery power. The battery power is supplied from the central power supply 118, through the HUD transducer circuitry and then to the back PASS 104 and finally to the front PASS 62. The circuitry in the HUD transducer housing 210 also preferably tracks the air supply using the HUD transducer 100 in combination with the manifold 212. When air pressure is sensed using the HUD transducer 100, the circuitry in the HUD transducer housing 210 turns on the front PASS 62, the back PASS 104 and any display associated with the HUD transducer. Thus, in one configuration, the circuitry wakes up the HUD transducer prior to the back PASS 104 and the front PASS 62 being awoken. In one particular configuration, the circuitry wakes up the HUD and back PASS 104 and the back PASS 104 wakes up the front PASS 62.

The circuitry also preferably calculates and tracks the air-time remaining based upon the air supply remaining in the tank 32. This information, together with information from the PASS devices, is logged and the information regarding remaining air time can be presented to the user through a HUD or other display, such as in the mask, for instance. In one configuration, a data log is created for each time the PASS devices 62, 104 are turned on, turned off or enter an alarm mode. In another configuration, the data log records the intervals of air remaining while the air is being used. In one preferred configuration, the data log captures the most recent 2,000 events. Other numbers of events also can be captured and retained for downloading. Further, the data logged can be downloaded to a personal computer or the like for analysis. For this reason, a data port can be provided. The data port can be housed in a water-resistant portion of the backpack assembly 30. In the presently preferred configuration, the data port is positioned behind the upper back support padding 36 in a water tight compartment. Other configurations are possible.

The circuitry can be connected to circuitry contained in the middle housing 102 using a pin sleeved cable 216. The cable can be hardwired to the circuitry contained in the HUD transducer housing 210 and can use spring pins 218 to connect to the circuitry in the middle housing 102. Other configurations also are possible.

The upper housing 74 also comprises the low air audible alarm 92. The audible alarm 92 can comprise speakers, bells or the like. The audible alarm 92 advantageously is positioned proximate an ear of a user and to a lateral side of any tank that may be carried by the backpack assembly 30.

Middle Housing

The middle housing 102 can contain one or more PASS devices 104. In the illustrated configuration, the middle housing 102 contains the left PASS device 104 and the right PASS device 104. As described above, the PASS device 104 is a personal alert safety system, which is a one-way communications device used by firefighters entering a building to alert others that the wearer of the PASS device is in trouble and in need of rescue. In the illustrated configuration, each PASS device 104 comprises the transducer or speaker 106 and the visual alert, such as the LED 110. Advantageously, each speaker 106 is angled outward such that the speaker 106 is angled away from the air cylinder 32 that is secured to the back frame 34 during use. In this manner, the sound emitted from the speaker 106 is less likely to be obstructed by the tank. The speakers preferably emit a sound pressure level of at least 95 dBA and preferably are tested to temperatures of at least 500° F.

The PASS device 104 can comprise a sensor configuration. For example, the sensor configuration can comprise a three-axis accelerometer or the like. In a preferred configuration, however, the signals regarding movement are provided to the back PASS device 104 from a sensor associated with the front PASS device 62, which experiences significantly more movement than the back PASS device 104 because the front PASS device 62 is dangling from the shoulder strap 46. Nevertheless, any suitable sensor configuration can be used. When the sensor configuration senses that no movement has occurred for a predetermined period (e.g., approximately 20 seconds), an alarm sequence is activated, which causes a sound to be emitted from the speaker 106 and causes the LED 110 to flash. The LED 110 also can flash to indicate that the PASS device 104 is operational and/or to indicate whether the PASS device 104 is in a sensing or alarm mode. The back PASS device 104 preferably powers the alert devices 106, 110.

Power is supplied to the back PASS devices 104 from the central power supply 118. The power is supplied separately to the HUD transducer 100 and the back PASS devices 104, which therefore can be separately powered. The separate power supplies also enable the back PASS devices 104 to be powered down without powering down the HUD transducer 100 and its associated circuitry. In addition, the back PASS devices 104 can be provided as separate modules and, therefore, the separate supply of power to the two devices enables simplified manufacture regardless of whether the optional back PASS devices 104 are included or not. In some embodiments, the back PASS device 104 together with the front PASS device 62 is powered separately from the HUD transducer 100. The back PASS device 104 together with the front PASS device 62 can be provided as separate modules and, therefore, the separate supply of power of the two devices enables simplified manufacture regardless of whether the optional back PASS device 104 together with the front PASS device 62 is included or not.

The back PASS device 104 also can provide power to the beacons 112. In a preferred configuration, the beacons 112 are not powered unless the PASS devices 104 enter an alarm mode. The beacons 112 can be positioned to the lateral sides of the middle housing 102. Preferably, the beacons 112 are somewhat protected by cages 113 that are positioned over the beacons 112. By positioning the beacons 112 to each lateral side, the beacons 112 are much more likely to be detected during a rescue operation.

Lower Housing

The lower housing 116 preferably comprises a central power source housing portion 222 positioned to one side of the lower housing 116. The housing portion 222 preferably is sized and configured to contain the four C-cell batteries in series described above. Other configurations also are possible. Preferably the power source housing portion 222 comprises a lower closure 224 that substantially seals an opening into a power source chamber defined within the central power source housing portion 222. The closure 224 preferably comprises a recessed portion that allows the closure to be removed with the use of a coin or a flathead screwdriver. Thus, the closure 224 protects the central power source while facilitating a rapid replacement of the central power source while in the field.

With reference again to FIG. 1, a bumper 226 preferably protects a lower portion of the back frame 34. In the illustrated configuration, the bumper 226 covers a lower portion of the back frame 34. The bumper 226 reduces the likelihood that the backpack assembly 30 will slip on a floor surface when not being worn and also reduces the likelihood that the backpack assembly will scratch a floor surface due to sliding on the floor surface when not being worn.

Figure 17:
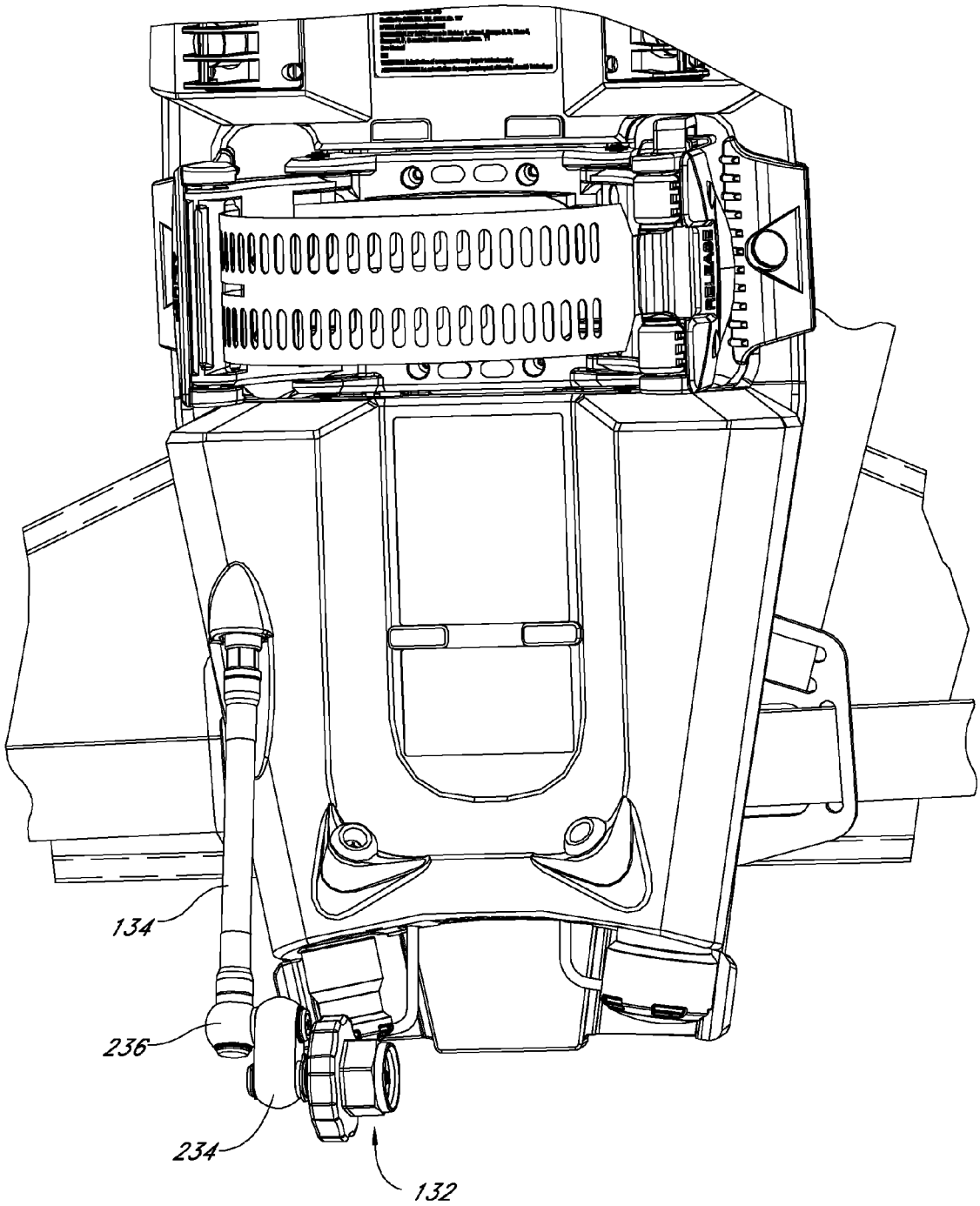
FIG. 17 is a perspective view of a lower portion of the backpack assembly of FIG. 1.

With reference to FIG. 17, a lower portion of the lower housing 116 preferably comprises at least one tank support 228 and a central tank recess 230. In the illustrated configuration, two tank supports 228 are positioned to support the tank, which is partially received within the central tank recess 230. In particular, the illustrated tank supports 228 are positioned on each side of the tank 32 and limit the downward movement of the tank 32 relative to the tank band assembly 114. The tank supports preferably 228 have a rubberized surface although other constructions are possible.

As shown in FIG. 2, a rapid intervention crew/company universal air connection system (RIC UAC) 232 is positioned at the bottom of the illustrated lower housing 116 proximate to the CGA wheel 132. The RIC/UAC 232 allows emergency replenishment of breathing air to the tank 32 in manners known to those of skill in the art.

Offset Swivel Assembly

Figure 18:
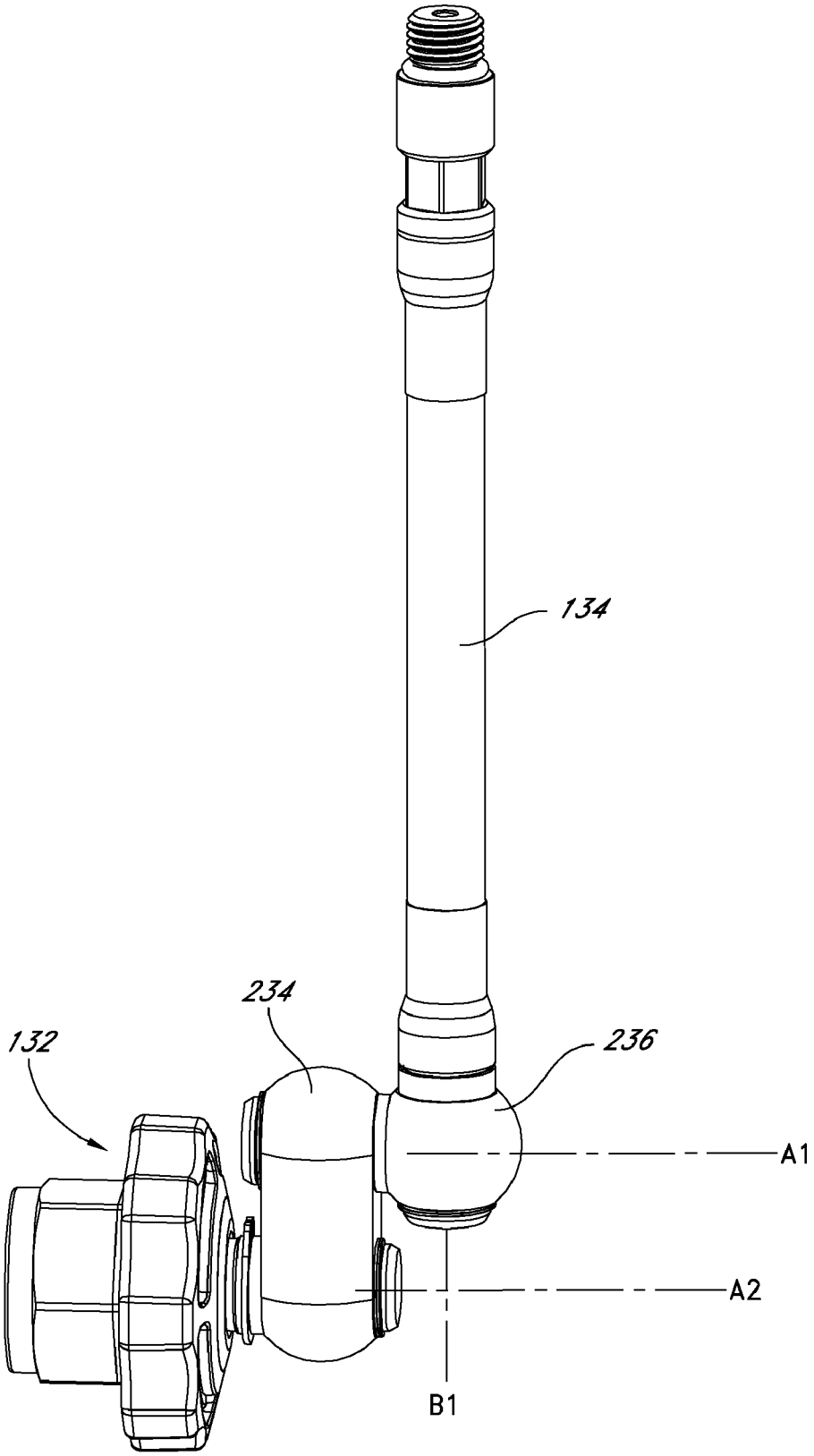
FIGS. 18 and 19 are perspective views of a hose and swivel attachment to a CGA wheel used in the backpack assembly of FIG. 1.
Figure 19:
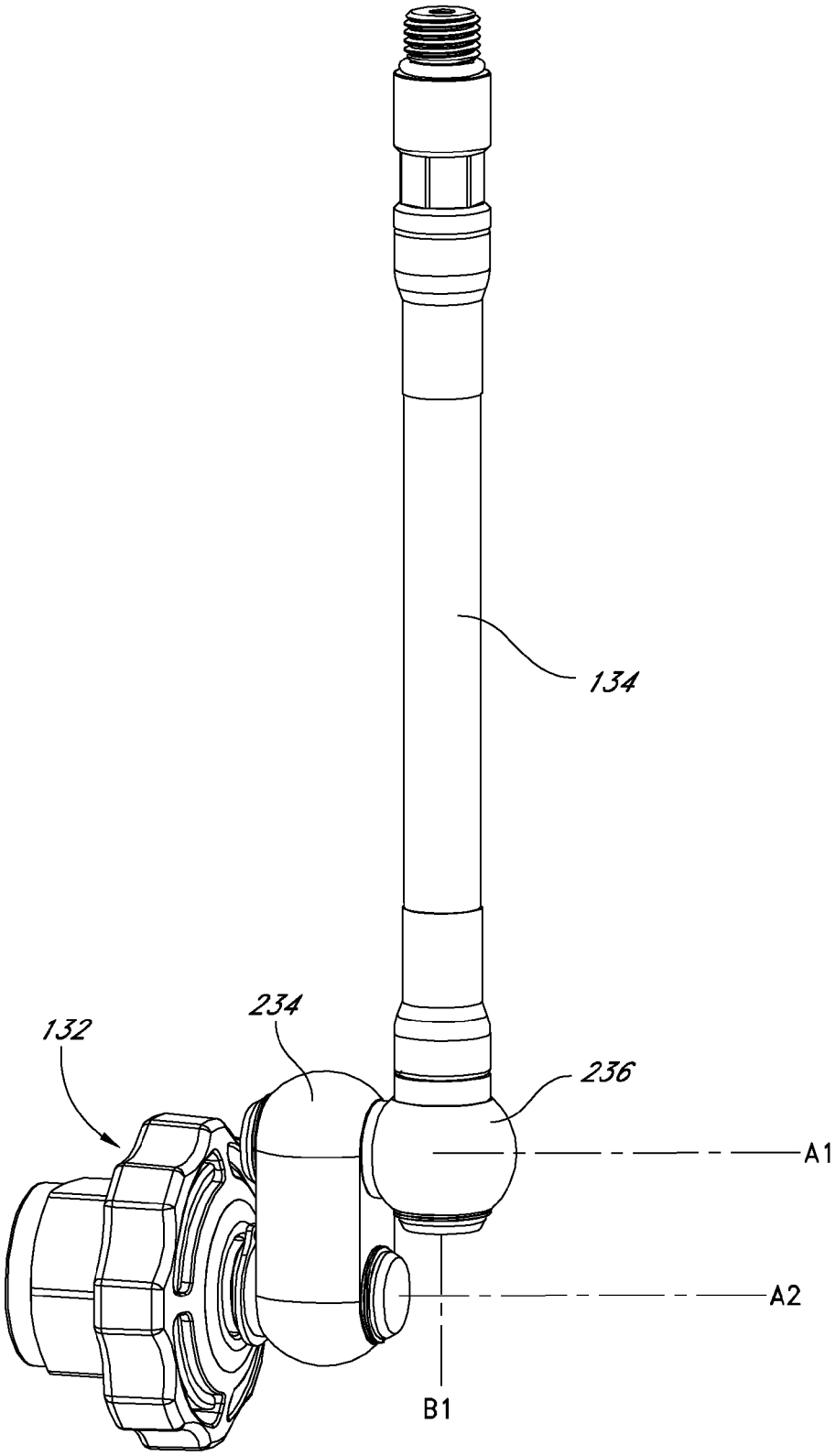

The offset swivel assembly 136 connects the hose 134 to the CGA wheel 132. With reference to FIG. 18 and FIG. 19, the swivel assembly 136 will be described in greater detail. As illustrated in FIG. 19, the illustrated swivel assembly 136 facilitates rotation about three axes: A1, A2 and B1. The first two axes A1, A2 are generally parallel to each other and the third axis B1 is generally perpendicular to the first two axes A1, A2. An offset link 234 connects the wheel 132 to a fitting 236 at the end of the hose 134. Preferably, a fluid passage is defined through a first pivot shaft that connects the fitting 236 and the offset link 234 and a fluid passage is defined through a second pivot shaft that connects the offset link 234 and the wheel 132. The offset link 234 also comprises a fluid passage. Accordingly, while the offset link 234 can rotate about the axis A1 and the axis A2, a fluid passage extends through the coupling between the hose 134 and the CGA wheel 132.

Quick Disconnect

Figure 22:
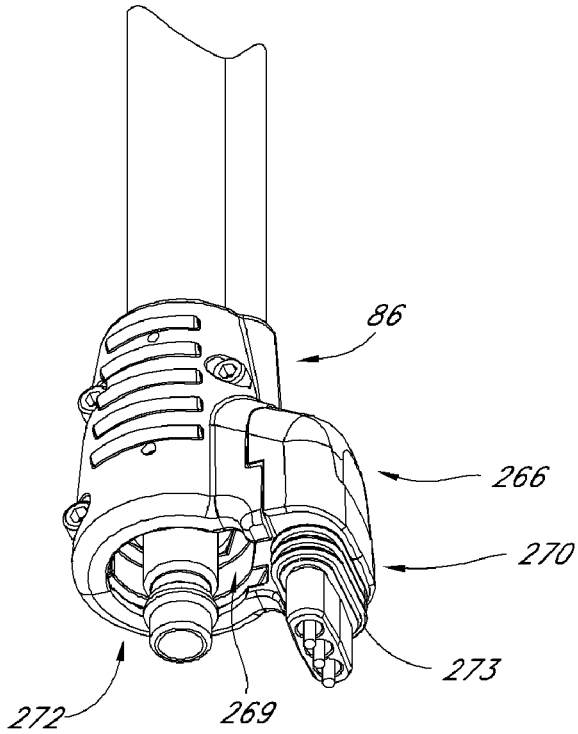
FIG. 22 is a perspective view of a portion of a unified electrical and pneumatic coupler used in the backpack assembly of FIG. 1.
Figure 22:
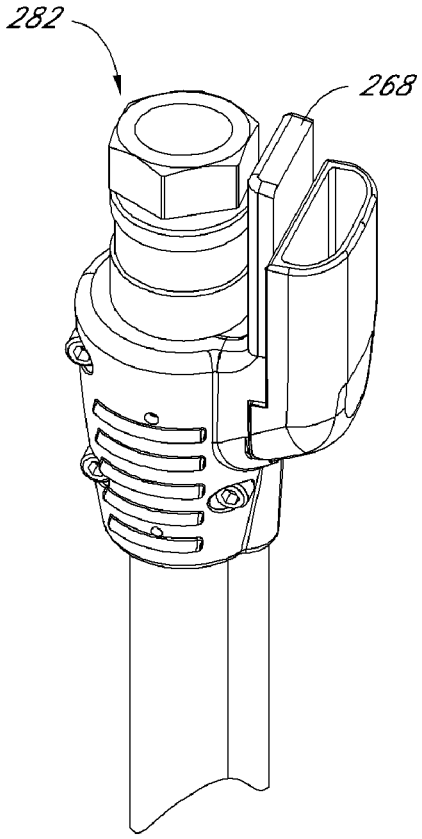

With reference to FIG. 1 and FIG. 22, the coupler 86 provides a simultaneous quick disconnect between two pneumatic hoses and two electrical cables. With reference to FIG. 22, a first portion 266 and a second portion 282 of the coupler 86 are shown. As illustrated, the coupler 86 features an electrical portion 270 and an air portion 272 that are integrated into a single component. The electrical portion of the first portion 266 can comprise a gasket 273. A raised wall 268 of the second portion 282 can be positioned within a recess 269 formed within the first portion 266. The raised wall 268 can be received within the recess 269, or other slot or opening, formed within the second portion 282, which mates with the first portion 266. The mating wall and slot align in only one angular orientation, which results in the pins of the electrical portion being properly aligned with respective sockets during coupling. Accordingly, the coupler 86 enables a connection between the air portions only when the electrical portions are properly aligned.

The coupler operates similar to most quick disconnects. To separate the two portions 266, 282 of the coupler 86, a push ring on the second portion 282 is urged toward the first portion 266. When the push ring moves, the two portions can be disconnected.

Front PASS Device

Figure 23:
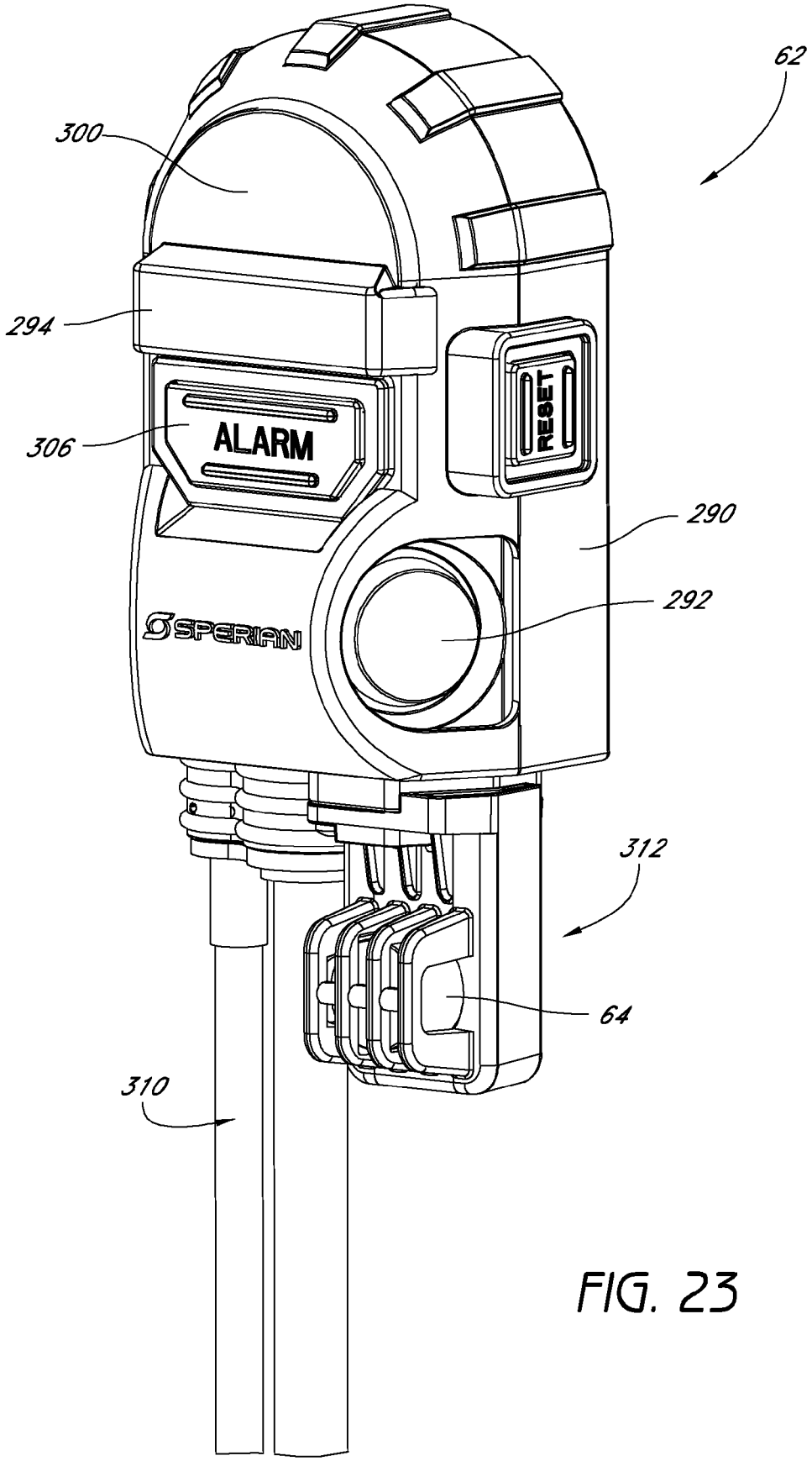
FIGS. 23 and 24 are perspective views of a front PASS unit used in the backpack assembly of FIG. 1.
Figure 24:
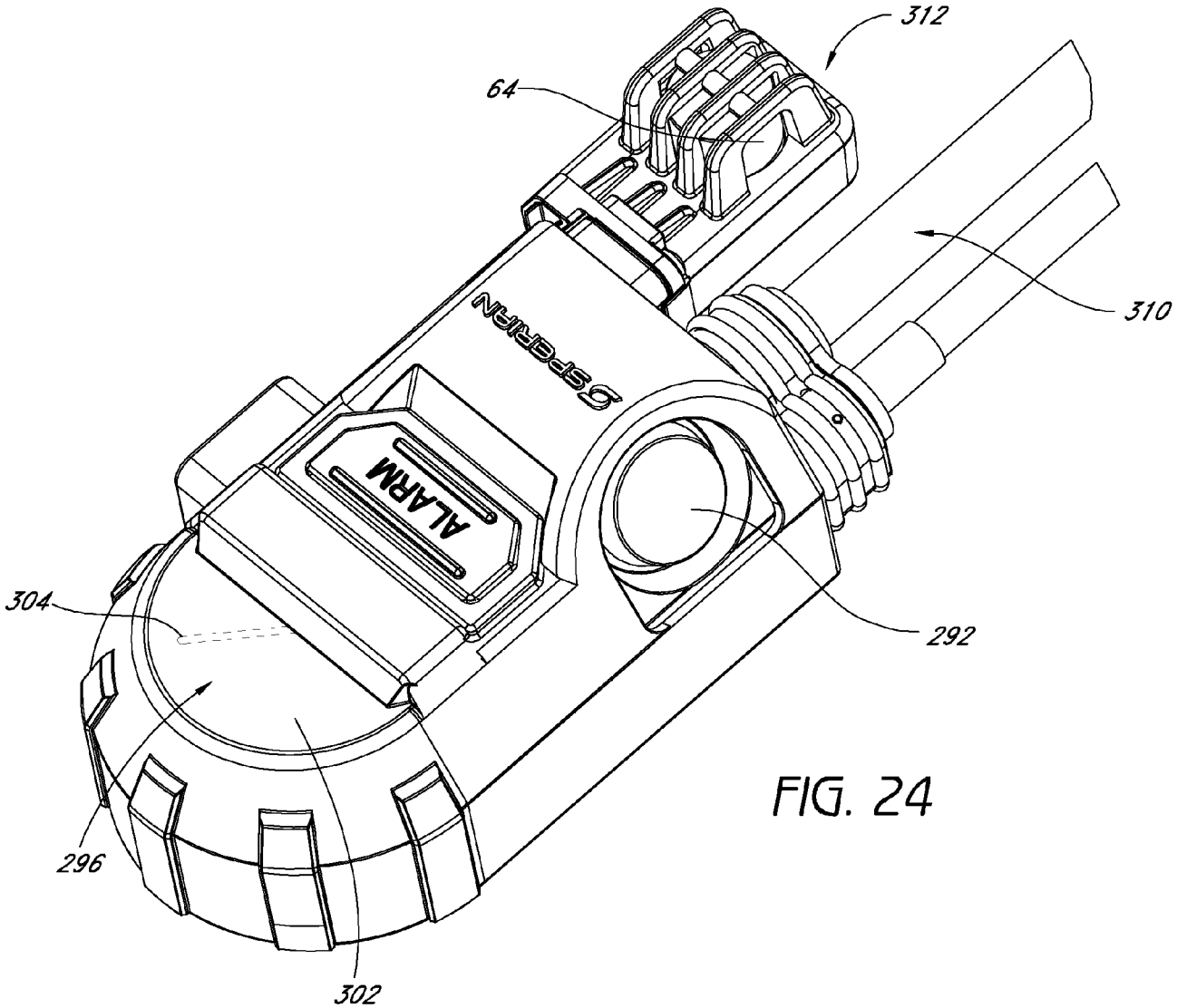

The front PASS device 62 is illustrated in FIG. 23 and FIG. 24. In some configurations, the front PASS device 62 may not be included with the backpack assembly 30. When included, however, it preferably is positioned along the right shoulder strap 46. The front PASS device 62 contains various circuitry, sensors and other components.

In one configuration, the front PASS device 62 comprises an outer housing 290. The outer housing 290 preferably is rugged and substantially liquid resistant. A motion detection apparatus can be positioned within the outer housing 290. The motion detection apparatus can comprise a three axis accelerometer. Other types of motion detection apparatuses can be used, including but not limited to, mercury switches and laser beams targeting a mirror on a spring.

The motion detection apparatus preferably is connected to circuitry that can be used to detect when the front PASS device 62 has been stationary for a preset period. In one configuration, the preset period is about twenty seconds. If the front PASS has been stationary for the preset period, then an alarm mode is entered. During the alarm mode, the front PASS drives a speaker 292 that is mounted in the outer housing 290. The front PASS 62 also drives the back PASS 104.

With reference still to FIG. 23, an LED lens 294 is mounted in the outer housing 290 or boot. The LED lens 294 overlies two or more status lights. The multiple LED lights positioned under the lens 294 provide improved visibility and provide redundant backup in case of LED failure. The multiple LED lights preferably flash periodically to indicate that the front PASS is operational and the multiple LED lights preferably flash more rapidly or in a different pattern to indicate that the power supply is running low. The multiple LED lights also enable green lights to be used with the front PASS 62 is in the sensing mode, while red lights are used with the front PASS 62 is in alarm mode and yellow (amber) lights are used to give a user battery status information, even when the backpack assembly 30 is not being used.

An analog gauge (see FIG. 24) is positioned under a gauge cover 300. The analog gauge is a redundant feature that advantageously works independent of the electronic sensing systems using data from the HUD transducer 100. The gauge preferably comprises a photoluminescent face 302, which improves the visibility of a needle 304. If power is needed for the analog gauge, an external power source can be provided.

As illustrated, an alarm button 306 can be provided. The alarm button 306 can be mounted in any orientation on the front PASS 62. Preferably, the alarm button 306 is large enough for easy manipulation by a gloved hand. The alarm button 306 allows a user to put the front PASS into alarm mode at any time simply by pressing the button 306. Thus, in the event of an emergency experienced by the user, the alarm button 306 can be depressed such that the front PASS, back PASS and any beacons enter the alarm mode. To reset the alarm, the alarm button 306 can be depressed two consecutive times.

To connect the front PASS 62 to the back PASS 104, a power cable 310 can be provided. Within the power cable 310 can be 2 power wires and three signal wires. The signal wires can comprise the following wires: low battery, signal, and ground. The power cable 310 can be hard wired to the front PASS 62 and can be connected to the back PASS 104 with spring pin couplers. In the illustrated configuration, a five spring pin coupler can be used. In some embodiments, more data can be transmitted with a power cable 310 having additional wires and a corresponding number of spring pins can be found on the associated spring pin coupler.

The illustrated front PASS 62 also has the beacon 64 built in to the front PASS housing 290. Because the beacon 64 can be an optional element, the beacon 64 is secured to the housing 290 with threaded fasteners and is positioned within its own protective housing 312. Other configurations are possible.

Tank Band Assembly

The tank band assembly 114 advantageously allows loosening with a single hand and facilitates rapid tank exchanges. As will be described with reference to FIG. 25, the tank band assembly 114 preferably comprises a locking mechanism 320 that can be released with a thumb and a cam latch mechanism 322 can be operated with a hand to loosen a tank band 324.

In one preferred configuration, the tank band 324 can be lengthened to expand a diameter of the tank band 324 or shortened to shrink a diameter of the tank band 324 by operating the cam latch mechanism 322, which is positioned to one side of the cylinder 32 in the illustrated configuration. Thus, the illustrated tank band assembly 114 facilitates the rapid exchange of cylinders having different diameters. In a preferred configuration, the tank band assembly 114 enables the backpack assembly 30 to accommodate tanks with diameters ranging from at least about 5 inches to at least about 7.3 inches. Once a cylinder is positioned within the tank band assembly 114, the slack of the tank band 324 can be slid into the cam latch mechanism 304, which can be snapped to a locked position prior to the tank band locking mechanism 320 tightening the tank band 324 around the cylinder 32.

Figure 25:
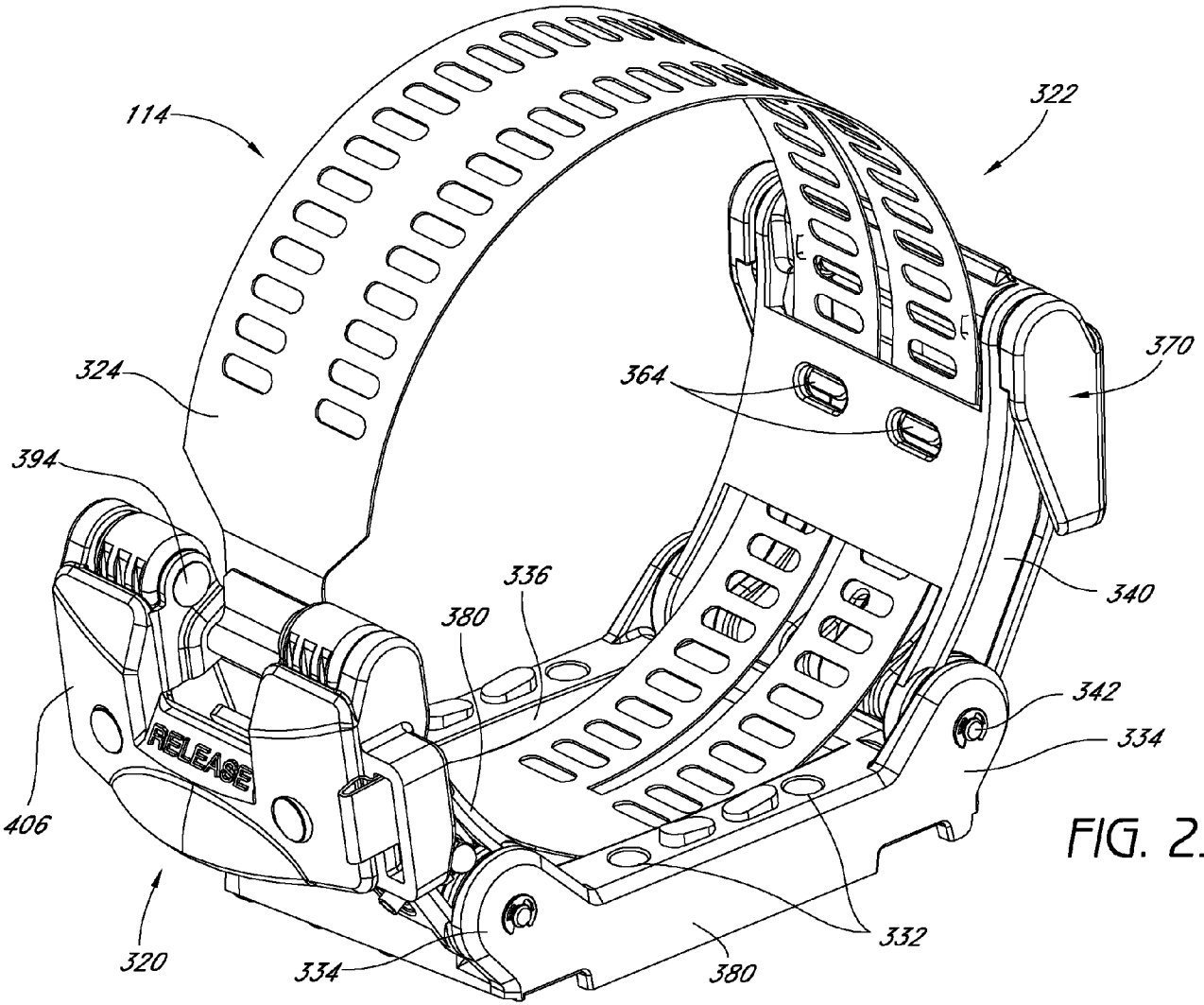
FIGS. 25-31 are views of a tank band assembly used in the backpack of FIG. 1.

With reference to FIG. 25, the illustrated tank band assembly 114 comprises a base 330. The base 330 can be used to secure the tank band assembly to the back frame 34. In the illustrated configuration, the base 330 comprises four mounting holes 332. The mounting holes can receive mechanical fasteners, which secure the base 330 to the back frame 34. In some configurations, the base 330 can be secured in other manners, including but not limited to, interlocking mechanical structures, adhesives and the like.

The illustrated base 330 comprises two pairs of ears 334. One set of the ears 334 pivotally connects the tank band locking mechanism 320 to the base 330 and the other set of ears 334 pivotally connects the cam latch mechanism 322 to the base 330. Other mounting configurations also can be used to secure the tank band locking mechanism 320 and the cam latch mechanism 322 to the base 330. A central portion of the base 330 also comprises a recess 336 that is generally cylindrical in shape. The recess 336 accommodates a portion of the tank band 324 that is not being used to secure the cylinder 32.

The cam latch mechanism 322 allows excess tank band to be removed from between the cam latch mechanism 322 and the tank band locking mechanism 320. The cam latch mechanism comprises a main pivot arm 340. The main pivot arm 340 preferably is pivotally connected to the base 330. In the illustrated configuration, a pivot shaft 342 connects the main pivot arm 340 to the respective ears 334. The shaft 342 can be secured in position in any suitable manner, such as through the use of snap rings 344, for instance but without limitation. In one configuration, the main pivot arm 340 can include ribs 345 (see FIG. 27) that abut upon the base 330 such that the range of pivotal movement of the main pivot arm 340 relative to the base 330 can be limited. The limited range advantageously reduces or eliminates the ability of the main pivot arm to flop from side to side when a tank is not mounted to the backpack assembly 30.

The main pivot arm 340 preferably defines a slot 346. The slot is sized and configured to receive the width and thickness of the tank band 324. In the illustrated configuration, the slot 346 is formed at least in part by an inner surface 350. Preferably, the inner surface is generally cylindrical in shape and defines a portion of a cylindrical surface in which the tank 32 will be positioned.

An upper portion of the main pivot arm 340 defines a through bore that contains a shaft 352. The shaft 352 supports two torsion springs 354 at each end of the shaft 352. The torsion springs preferably are housed within the portion of the main pivot arm 340 through which the shaft extends. The main pivot arm 340 also comprises slots 356 that receive one end of the torsions springs 354. The other end of the torsion springs 354 preferably connect to a locking bracket 360. Thus, the locking bracket 360 can be biased into an open position when no tank 32 is mounted to the backpack assembly 30.

Figure 26:
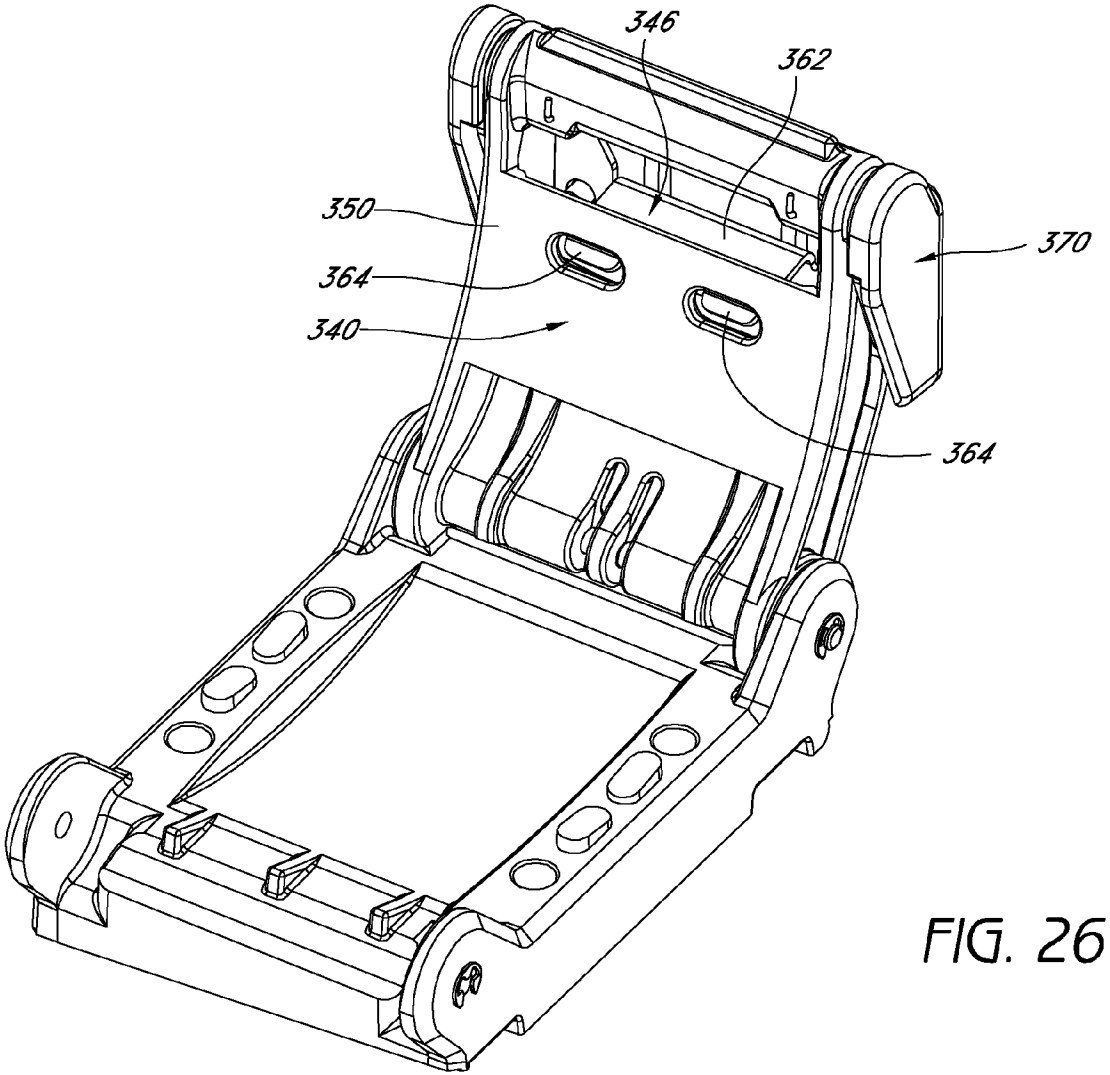
Figure 27:
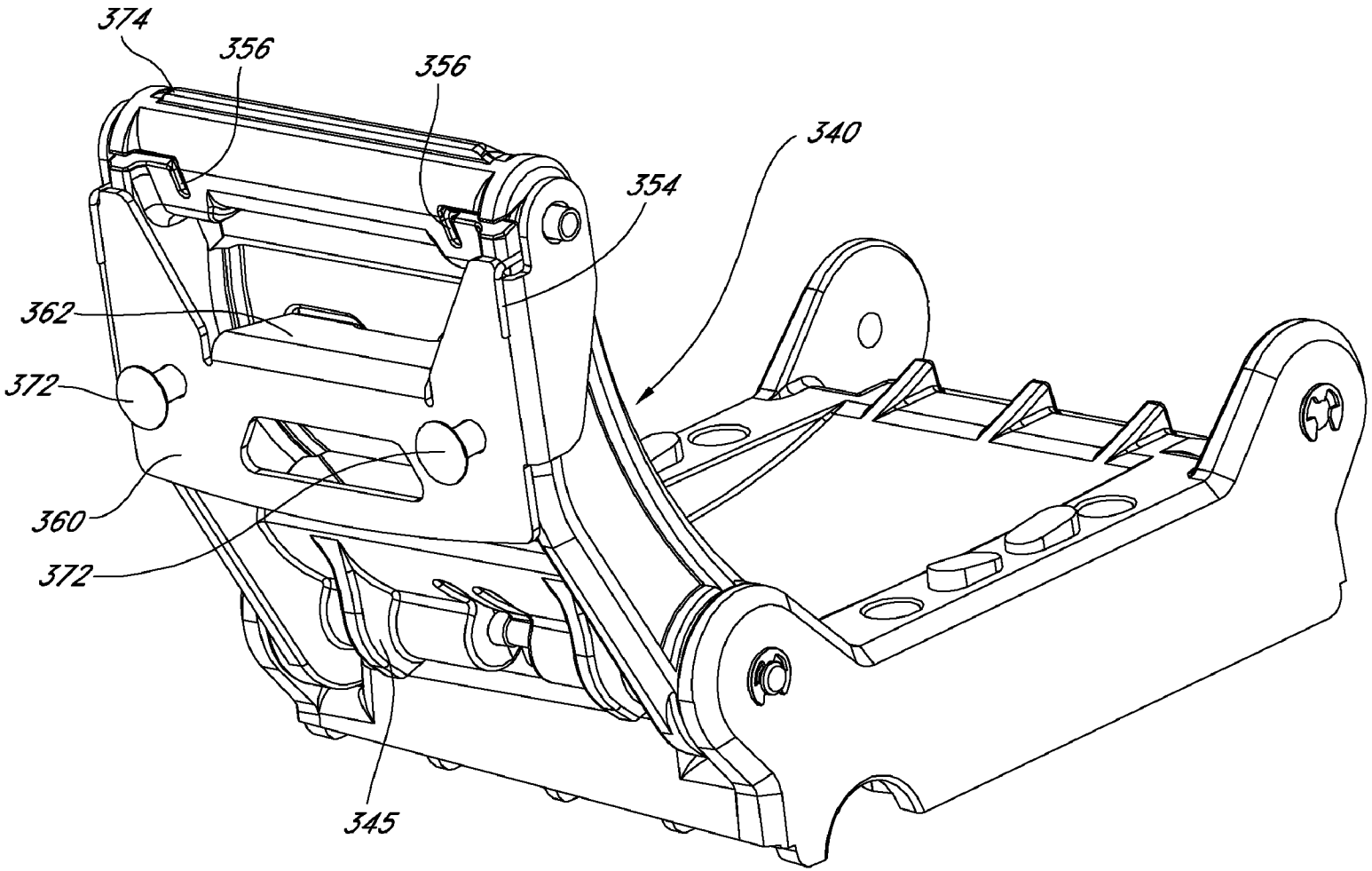

The locking bracket 360 is pivotally connected to the main pivot arm 340 by the shaft 352. In the illustrated configuration, the locking bracket 360 comprises a tab 362 that ends in at least one tooth 364, but preferably two teeth 364 are provided. The two teeth 364 extend into the slot 346 when the locking bracket 360 is in a closed position, which is shown in FIGS. 26 and 27. When the teeth are engaged with the tank band 324, the ends of the teeth maintain the locking bracket 60 in the closed position. Preferably, the inner surface 350 of the main pivot arm 340 also comprises corresponding apertures 366. The apertures, in one configuration, accommodate the teeth 364 when the locking bracket 360 is pivoted to the closed position.

For aesthetic reasons and for improving the grip one can get on the locking bracket 360, a handle 370 (omitted from FIG. 27 to clearly show the locking bracket 360) can be secured over the outer portion of the locking bracket 360. The handle 370 can be sized and configured as desired. In the illustrated configuration, the handle 370 is secured to the locking bracket 360 with rivets 372 or other mechanical fasteners. Other suitable fastening techniques also can be used.

As explained above, the torsion springs 354 urge the locking bracket 360 toward the opened position. Thus, to limit the movement of the locking bracket 360 and the handle 370 in the opened direction, a rib 374 is positioned on the main pivot arm 340. When the handle 370 is moved toward the opened position, an upper surface of the illustrated handle 370 comes into abutment with the rib 374 such that the range of handle movement can be limited. Other constructions can be used.

Figure 28:
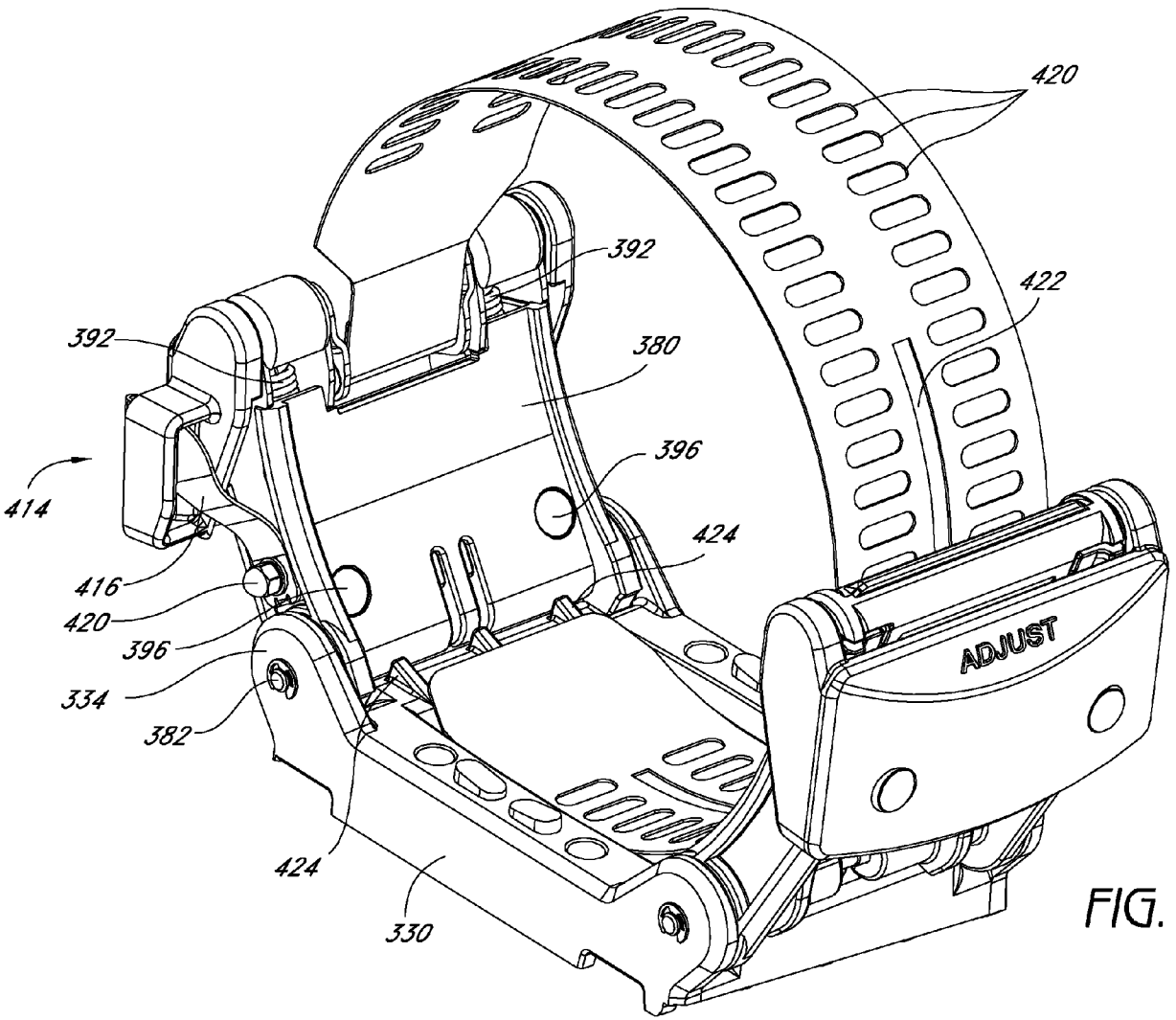

With reference now to FIG. 28, the tank band locking mechanism 320 will be described in further detail. The mechanism 320 also comprises a main pivot arm 380. A pivot shaft 382 pivotally couples the main pivot arm 380 to the ears 334 of the base 330. The pivot shaft 382 can be secured in position in any suitable manner, such as through the use of snap rings 384 or the like.

Figure 29:
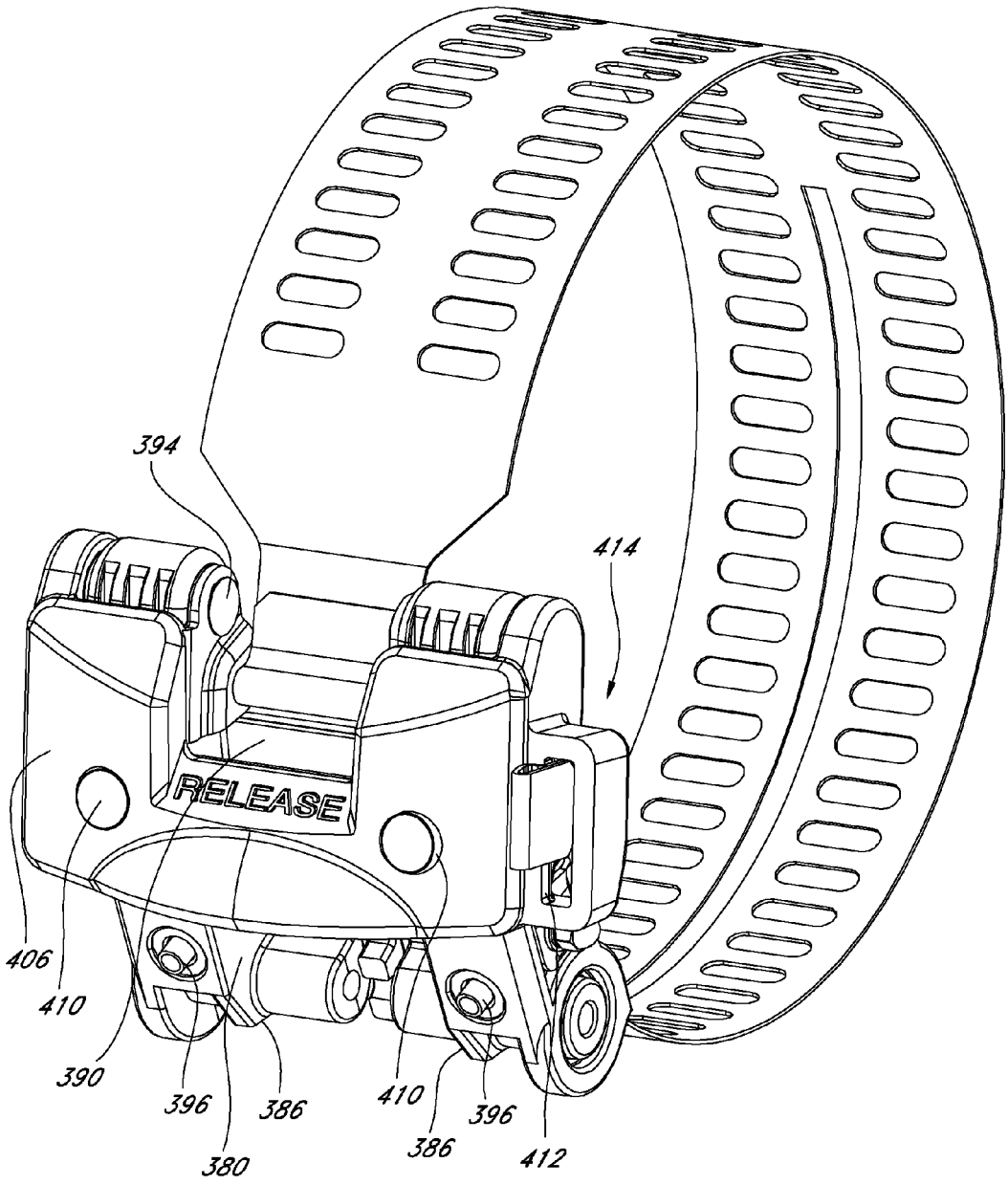

The main pivot arm 380 preferably comprises structure that works together with structure on the base 330 to limit the pivot range of the main pivot arm 380 relative to the base 330. In the illustrated arrangement, the main pivot arm 380 comprises ribs 386 (FIG. 29) that abut on the base 330 to limit the movement of the main pivot arm 380 toward the other main pivot arm 340. Because the tank band 324 connects the two pivot arms 340, 380 and because the main pivot arms 340, 380 each limit the range of movement in opposing directions, the overall movement of the three components can be limited in each direction when no tank 32 is enclosed by the assembly 114.

A support bracket 390 (see FIG. 30) has a tab that extends downward into a pocket formed in the main pivot arm 380. Helical springs 392 are mounted to shafts 394 at their upper ends and are mounted to rivets 396 or other mechanical fasteners or structures formed in the main pivot arm 380. The springs 392 allow some relative movement between the support bracket 390 and the main pivot arm 380.

Figure 30:
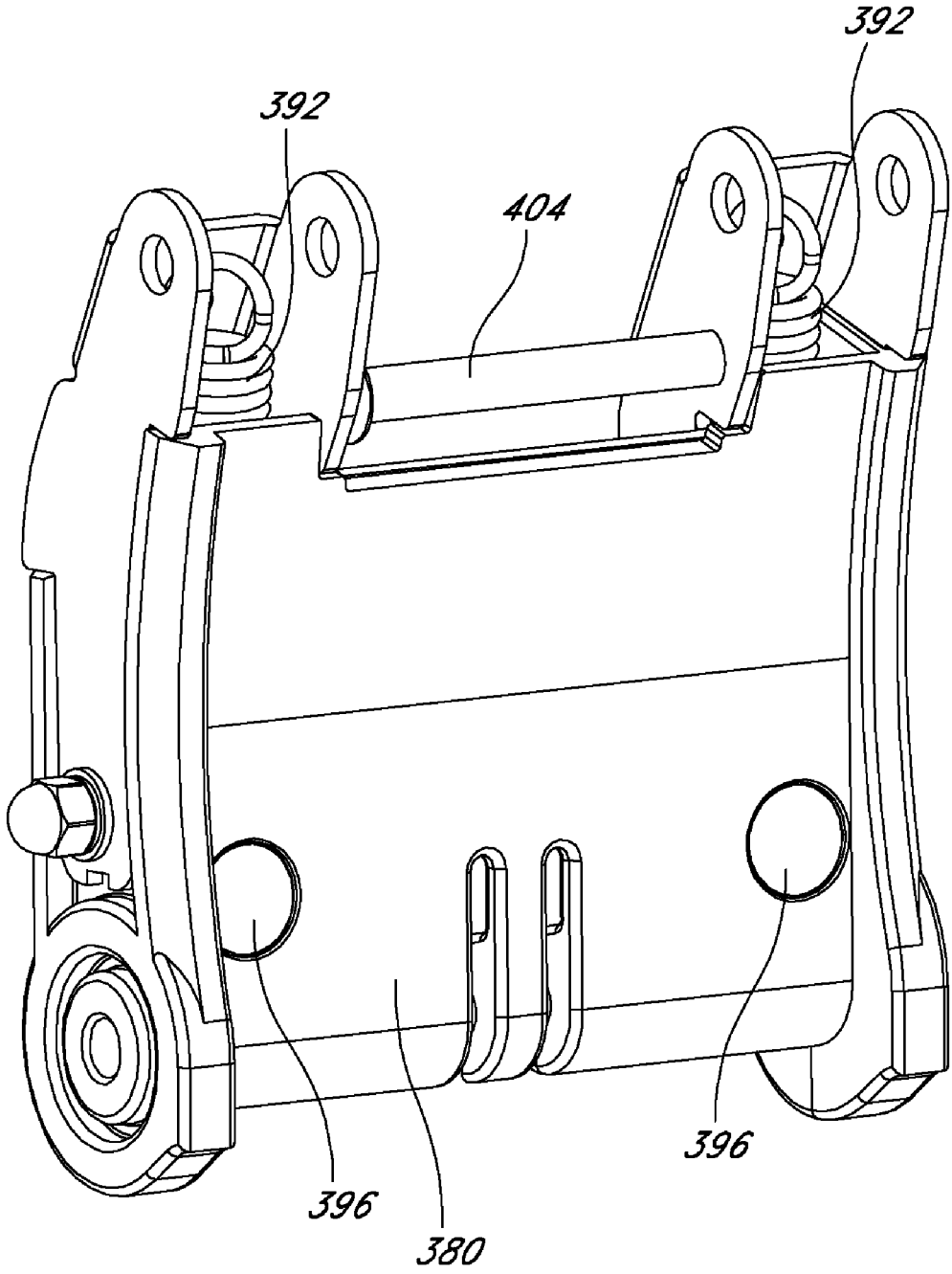
Figure 31:
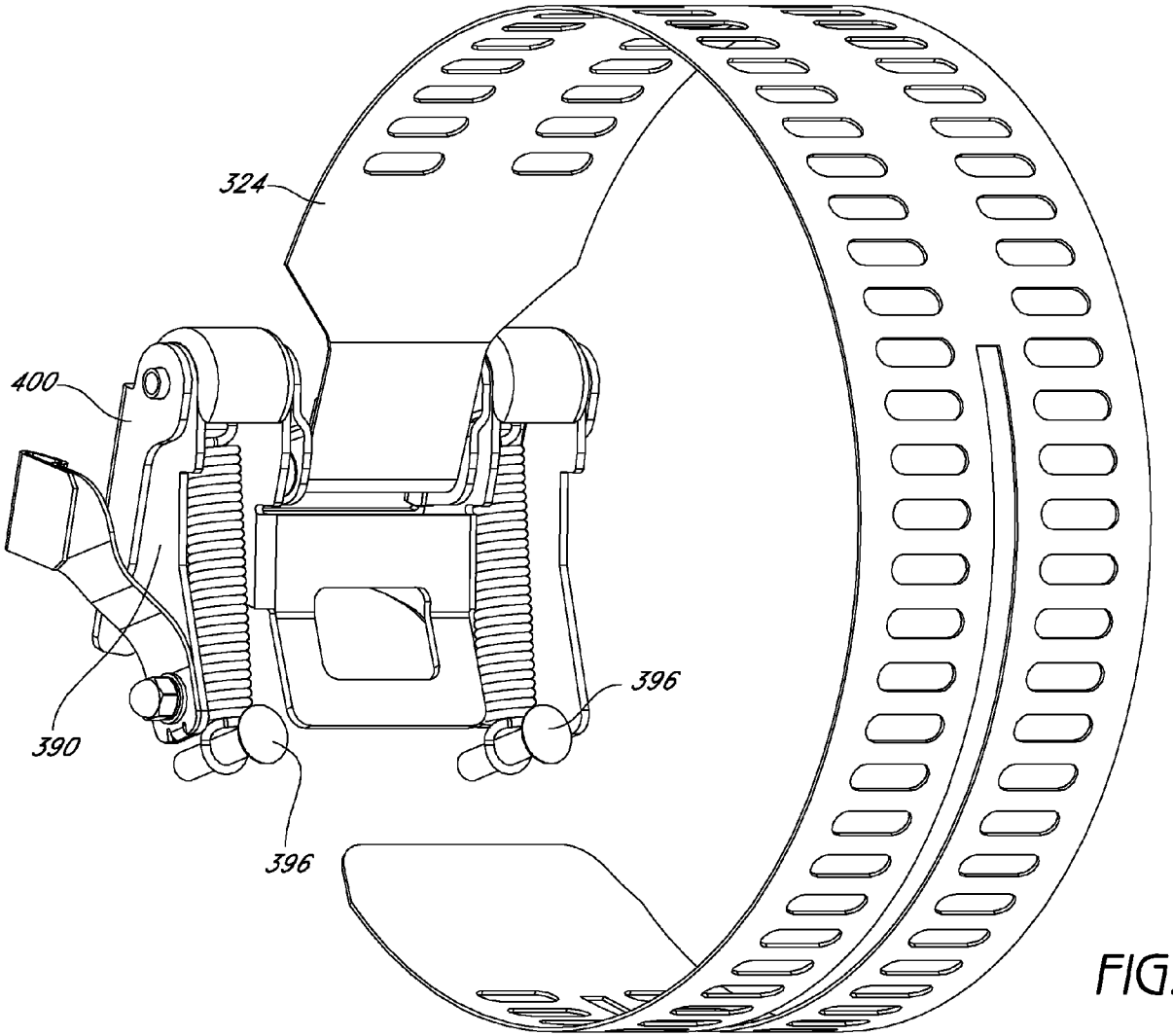
Figure 32:
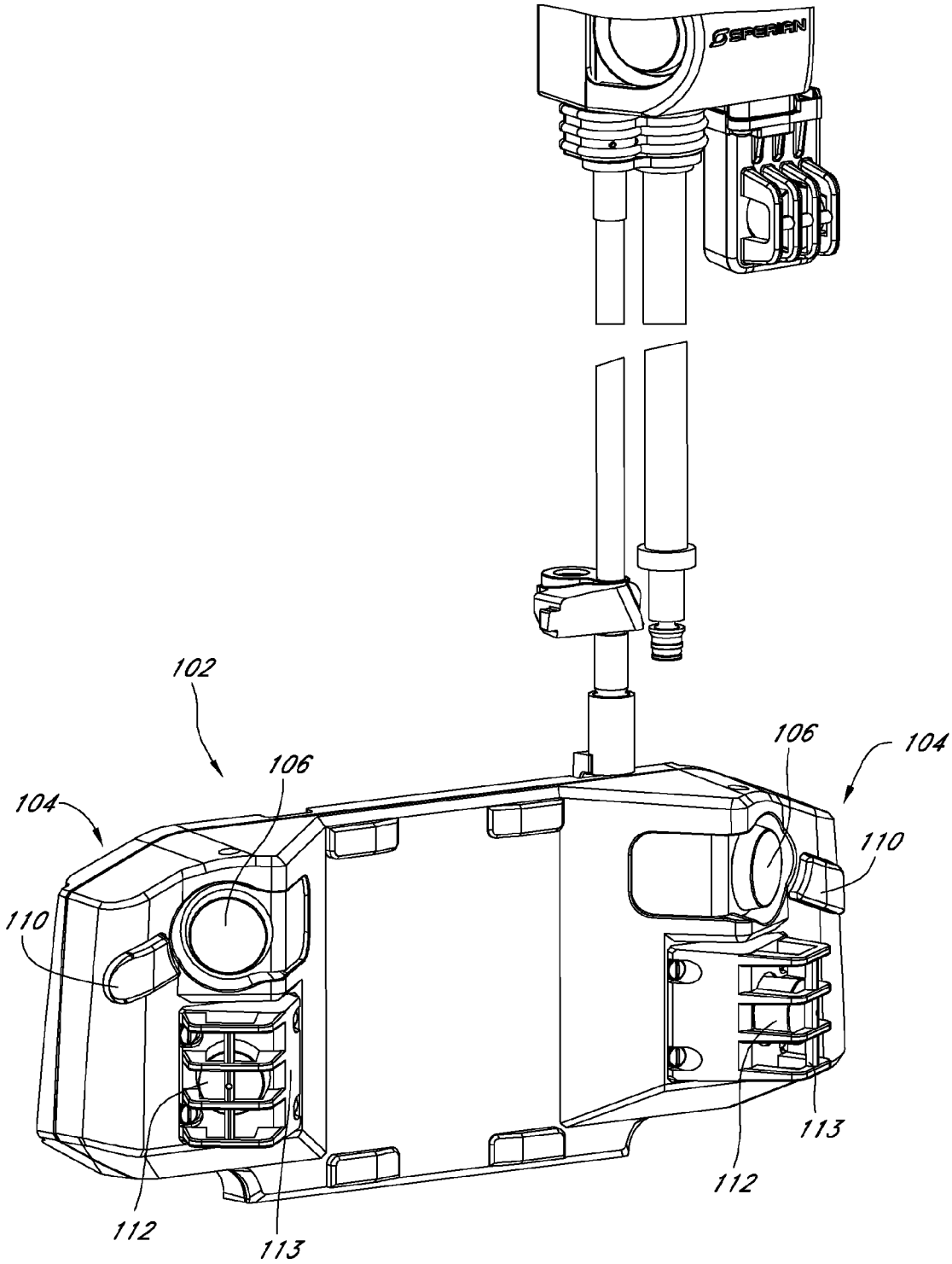
FIG. 32 is a perspective view of a housing containing a back PASS device and ultrasonic beacons used in the backpack of FIG. 1.

With reference to FIG. 31, a cam bracket 400 is pivotally coupled to the support bracket 390 with the shafts 394. The cam bracket 400 therefore can pivot about the shafts 394 relative to the support bracket 390. An end portion 402 of the tank band 324 preferably is rolled or otherwise connected to a member forming a passage. The passage receives a shaft 404 (FIG. 30). The shaft 404 is supported by the cam bracket 400. Advantageously, the shaft 404 is positioned lower (in the figures) than the shafts 394. Thus, when the cam bracket 400 pivots downward relative to the support bracket 390, the end portion 402 of the tank band 324 is moved such that the band tightens around the cylinder 32. In addition, by virtue of the forces loaded on the locking mechanism 320 when the cylinder 32 is captured by the band 324, the cam bracket 400 tends to stay in the closed position without any retaining feature.

A handle 406 (FIG. 29) can be secured to the cam bracket 400 in any suitable manner. In the illustrated configuration, the handle 406 is secured with rivets 410 or other mechanical fasteners. The handle 406 can comprise a first portion or strike 412 of a latch lock assembly 414. The strike 412 can be positioned within a generally enclosed passage at one side of the handle 406. A finger 416 preferably is joined to the support bracket 390 by a mechanical fastener 420 of the like. The finger 416 engages the strike 412 of the latch lock assembly 414 when the handle 406 is pivoted to the closed position. In this manner, the latch lock assembly 414 assists in maintain the tank band locking mechanism 320 in a closed position. Of course, to unlock or open the tank band locking mechanism 320, a user can push the finger 416 over the strike 412 and raise the handle 406 to release the tension on the band 324.

The tank band 324 preferably comprises a plurality of apertures 420. In the illustrated configuration, the apertures 420 correspond in size, shape and position to the teeth 364 of the cam latch mechanism 322. Preferably, the teeth are punched from the inside surface of the tank band 324 to reduce the likelihood of damage to the tank by the minimal burring that could result. A portion of the tank band 324 also comprises a central slot 422. While the illustrated slot 422 is positioned centrally, other locations also can be used. The slot 422 preferably also is formed from the inside surface of the tank band 324. Moreover, in some configurations, the tank band 324 features rolled outer surfaces to further protect the tank 32.

The slot 422 advantageously does not extend fully to either end of the tank band 324. A protrusion formed in the cam latch mechanism rides in the slot 422. In one configuration, the protrusion is formed on a back side of the inner surface 350. The protrusion and the slot cooperate to limit the amount of outfeed or infeed of the tank band 324 relative to the cam latch mechanism 322.

With continued reference to FIG. 28, the base 330 preferably also comprises sloping bosses 424 or other such surfaces to reduce the likelihood that the tank band 324 will feed between the base 330 and the main pivot arm 380. Other suitable configurations also can be used.

In accordance with the description above, the distance of the tank to the lumbar spine can be minimized. In addition, the center of the tank can better align with the lower thoracic region, which allows a more upright trunk posture. Moreover, pressures measured at the scapular and sacral regions are negligible (equal or less than about 5 pounds) while traditional SCBAs measure up to 15 pounds of pressure at the scapular region and 22 pounds at the sacral region.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. A backpack assembly for a self contained breathing apparatus, the backpack assembly comprising:

a back frame comprising a rearward surface and a forward surface, the rearward surface and the forward surface being connected by at least one peripheral surface, at least one handle being defined by an opening that is positioned along the peripheral surface;

a waist pad connected to the back frame with a hip plate, the hip plate being connected to the forward surface of the back frame;

a shoulder strap connected to the back frame, a front PASS device being supported by the shoulder strap, the front PASS device being connected by a conduit to an upper housing;

the upper housing being mounted to the rearward surface of the back frame, the upper housing comprising a low air audible alarm, a low air visual alarm, a low battery visual alarm and a transducer for a heads-up display;

a middle housing being mounted on the rearward surface of the back frame generally below the upper housing, the middle housing comprising a back PASS device, the back PASS device comprising at least one audible alarm device, at least one visual alarm device and at least one firefighter locating beacon;

a tank band assembly being mounted on the rearward surface of the back frame, the tank band assembly being positioned generally below the middle housing, a tank being mounted within the tank band assembly;

a lower housing being mounted on the rearward surface of the back frame, the tank being supported by the lower housing, the lower housing comprising a central power supply, the lower housing also comprising a first stage regulator;

a CGA wheel being connected to an offset swivel assembly, the offset swivel assembly is connected to a hose and the hose being connected the first stage regulator.

2. The backpack assembly of claim 1, wherein the hip plate is removably connected to the back frame.

3. The backpack assembly of claim 2, wherein the hip plate can be connected to the back frame in at least two different positions such that the placement of the hip plate along the back frame is adjustable.

4. The backpack assembly of claim 1 further comprising upper padding secured to an upper portion of the back frame.

5. The backpack assembly of claim 1, wherein a harness is connected to the back frame, the harness comprising two shoulder straps and back straps that are connected to the shoulder straps, the back straps also being connected to the hip plate, the harness also comprising a waist belt that is connected to the waist pad.

6. The backpack assembly of claim 5 further comprising hand grabs that are attached to ends of the shoulder straps.

7. The backpack assembly of claim 5, wherein at least one of the hand grabs comprises a sleeve and an insert, the insert defines a passage and teeth extend into the passage.

8. The backpack assembly of claim 7, wherein the passage is defined by a tab and the tab comprises studs that extend outward from the tab.

9. The backpack assembly of claim 7, wherein the insert can be secured within the sleeve.

10. The backpack assembly of claim 7, wherein the sleeve comprises at least one slot that extends in the insertion direction of the insert and the insert comprises at least one post, the post being slideable along the slot such that the post is exposed through the slot.

11. The backpack assembly of claim 5 further comprising hand grabs that are attached to ends of the waist belt.

12. The backpack assembly of claim 5, wherein one or more of the shoulder straps and waist belts comprising a first side and a second side, the first side having a portion that is colored differently from a portion of the second side such that a twisted belt can be readily identified.

13. The backpack assembly of claim 1 further comprising a first pneumatic hose and a first electrical cable that are connected to the upper housing, a second pneumatic hose and a second electrical cable being connected to a second stage regulator, the second stage regulator being connected to the second pneumatic house and the second electrical cable, the first electrical cable, the first pneumatic hose, the second electrical cable and the second pneumatic hose being coupled by a single coupling member, the single coupling member comprising a first portion and a second portion, the first portion and the second portion being configured for connection in only one angular orientation.

14. The backpack assembly of claim 1, wherein the central power supply is electrically connected to the HUD transducer, the back PASS device and the front PASS device.

15. The backpack assembly of claim 1, wherein the offset swivel assembly comprises a fitting that is connected to a first stage regulator within the lower housing by a flexible hose, a first pivot shaft that is connected to the fitting on the flexible hose, an offset link that is connected to the first pivot shaft, a second pivot link being connected to the offset link, the CGA wheel being connected to the second pivot link, and a fluid passage extending through the fitting, the first pivot shaft, the offset link, the second pivot shaft and the CGA wheel.

16. The backpack assembly of claim 1, wherein three handles are defined in the back frame, the three handles being positioned along the top and along both lateral sides of the back frame respectively.

17. The backpack assembly of claim 1, wherein the handle can support a 1000 pound load.

18. The backpack assembly of claim 1, wherein the handle is further defined by a reinforcing plate.

19. The backpack assembly of claim 1 further comprising a carabineer attachment point defined between the opening that defines the handle and the peripheral surface of the back frame.

20. The backpack assembly of claim 1, wherein the hip plate is connected to the back frame through a resilient bushing.

21. The backpack assembly of claim 20, wherein the hip plate comprises a pin that extends through a mounting structure, the mounting structure comprising the bushing and the bushing comprising two pairs of fingers and a recess, the pin being positioned within the recess with the fingers contacting the pin such that movement of the pin causing deflection of the fingers.

22. The backpack assembly of claim 21, wherein the bushing has a thickness and the fingers extend less than the full thickness of the bushing.

23. The backpack assembly of claim 21, wherein the bushing comprises at least two mounting holes, a bushing plate is secured over the bushing such that the pin is captured within the recess, and the bushing plate comprises at least two mounting holes that correspond to the mounting holes of the bushing.

24. The backpack assembly of claim 23, wherein the bushing plate has an outer diameter that is slightly smaller than an outer diameter of the bushing.

25. The backpack assembly of claim 23, wherein at least one standoff separates the bushing plate from the back frame.

26. The backpack assembly of claim 21, wherein the hip plate comprises two mounting ears that straddle the bushing, the pin being connected to the two mounting ears.

27. The backpack assembly of claim 20, wherein the pin extends generally horizontally when the backpack assembly is supported in a generally vertical orientation.

28. The backpack assembly of claim 1, wherein the hip plate is connected to the back frame through a mounting structure, the mounting structure comprising a resilient bushing, the hip plate comprising a generally t-shaped configuration with a generally horizontally extending base and a generally vertically extending central portion that is position generally centrally along the base, the mounting structure being positioned along the central portion and the base being positioned generally lower than the mounting structure.

29. The backpack assembly of claim 1 further comprising a pivot pin that connects the hip plate to the back frame, the pivot pin extending generally horizontally and comprising a center axis, the center axis being vertically spaced from a center of a waist belt, and the waist belt being connected to the waist pad.

30. The backpack assembly of claim 1, wherein the low air audible alarm comprises a sound emitter that is positioned in the upper housing to a lateral side of the tank.

31. The backpack assembly of claim 1, wherein the middle housing comprises a second back PASS device, an audible alarm of the second back PASS device and the audible alarm of the back PASS device being separated by the tank.

32. The backpack assembly of claim 31, wherein the audible alarms of the first and second back PASS devices are angled outward away from the tank.

33. The backpack assembly of claim 1, the middle housing comprises a second back PASS device, a visual alarm of the second back PASS device and the visual alarm of the back PASS device being separated by the tank.

34. The backpack assembly of claim 1, wherein the back PASS device is powered separate of the HUD transducer of the upper housing.

35. The backpack assembly of claim 1 further comprising a bumper that covers a lower portion of the back frame.

36. The backpack assembly of claim 1, wherein the lower housing comprises at least one tank support, the tank support abutting the tank and providing support to a bottom portion of the tank.

37. The backpack assembly of claim 1, wherein the front PASS device comprises an alarm reset button.

38. The backpack assembly of claim 1, wherein the front PASS device comprises an analog air pressure gauge.

39. The backpack assembly of claim 1, wherein the front PASS device comprises an audible alarm.

40. The backpack assembly of claim 1, wherein the front PASS device comprises a visual alarm.

41. The backpack assembly of claim 40, wherein the visual alarm of the front PASS device comprises LEDs of more than one color.

42. The backpack assembly of claim 1, wherein the front PASS device and the back PASS device are electrically connected.

43. The backpack assembly of claim 1, wherein the front PASS device comprises a firefighter locator beacon.

44. The backpack assembly of claim 1, wherein the tank band assembly comprises a tank band that extends through a locking mechanism and a cam latch mechanism.

45. The backpack assembly of claim 44, wherein the tank band assembly enables the backpack assembly to accommodate tanks with diameters ranging from at least about 5 inches to at least about 7.3 inches.

46. The backpack assembly of claim 45, wherein the tank band assembly comprises a base that is secured to the back frame, the locking mechanism being pivotally connected to the base and the cam latch mechanism being pivotally connected to the base.

47. The backpack assembly of claim 46, the locking mechanism and the cam latch mechanism being separated by a central portion of the base, the central portion of the base comprising a recess that forms a portion of a generally cylindrical shape.

48. The backpack assembly of claim 47, wherein a portion of the tank band overlaps at least part of the central portion of the base.

49. The backpack assembly of claim 44, wherein the cam latch mechanism comprises a main pivot arm, the main pivot arm being connected to the base, the main pivot arm defining a slot, the tank band extending through the slot, a locking bracket pivotally connected to the arm, and the locking bracket comprising at least one tooth that interacts with the tank band.

50. The backpack assembly of claim 49, wherein the locking mechanism comprises a main pivot arm, the main pivot arm being connected to the base, an end of the tank band being connected to a support bracket that extends into a pocket formed in the main pivot arm, and a cam bracket being pivotally connected to the support bracket.

51. The backpack assembly of claim 50, wherein a spring coupling limits movement of the support bracket relative to the main pivot arm.

52. The backpack assembly of claim 50 further comprising a handle connected to the cam bracket.

53. The backpack assembly of claim 52 further comprising a latch lock assembly extending between the handle and the support bracket.

* * * * *